United States Patent [19]

Deutsch

[11] 3,956,960

[45] May 18, 1976

[54] FORMANT FILTERING IN A COMPUTOR ORGAN

[75] Inventor: Ralph Deutsch, Sherman Oaks, Calif.

[73] Assignee: Nippon Gakki Seizo Kabushiki Kaisha, Hamamatsu, Japan

[22] Filed: July 25, 1974

[21] Appl. No.: 491,745

[52] U.S. Cl. ..... 84/1.19; 84/1.11; 84/DIG. 9; 235/152; 235/197; 333/70 R

[51] Int. Cl.[2] ..... G10H 1/00; G10H 5/00

[58] Field of Search ..... 84/1.01, 1.03, 1.11–1.13, 84/1.19–1.24, DIG. 9; 179/1 D, 1 M, 1 VC; 235/152, 197; 307/260, 264; 328/170; 333/70 R, 81 R

[56] References Cited

UNITED STATES PATENTS

| | | | |
|---|---|---|---|
| 3,610,799 | 1/1971 | Watson | 84/1.01 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,809,792 | 5/1974 | Deutsch | 84/1.24 |

*Primary Examiner*—L. T. Hix
*Assistant Examiner*—Stanley J. Witkowski
*Attorney, Agent, or Firm*—Howard A. Silber

[57] ABSTRACT

Formant filtering is implemented in a computor organ of the type disclosed in U.S. Pat. No. 3,809,786 by eliminating, attenuating or accentuating certain Fourier components included in each waveshape amplitude computation. A set of formant filter factors define the formant filter passband as a function of frequency, logarithmic frequency or Fourier component order. As each constituent Fourier component is independently evaluated, the component amplitude is scaled by the appropriate formant filter factor. The resultant synthesized musical tone includes only Fourier components within the defined passband, so that formant filtering effectively is implemented without the use of an actual filter.

29 Claims, 15 Drawing Figures

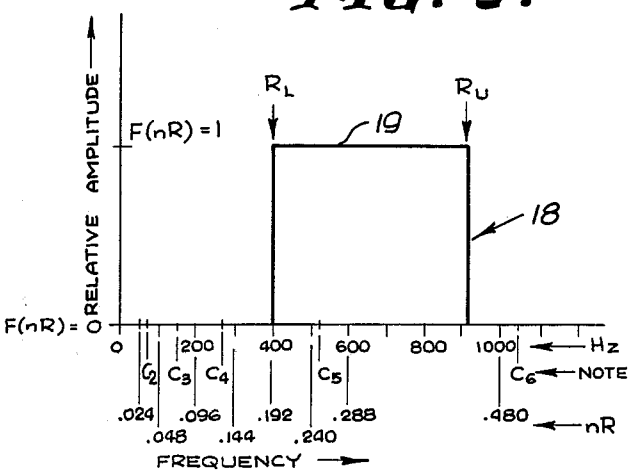
FIG. 2.
RELATIVE AMPLITUDE
F(nR) = 1
F(nR) = 0
$R_L$
$R_U$
18
19
0
200
400
600
800
1000
Hz
$C_2$
$C_3$
$C_4$
$C_5$
$C_6$
NOTE
.024
.048
.096
.144
.192
.240
.288
.480
nR
FREQUENCY

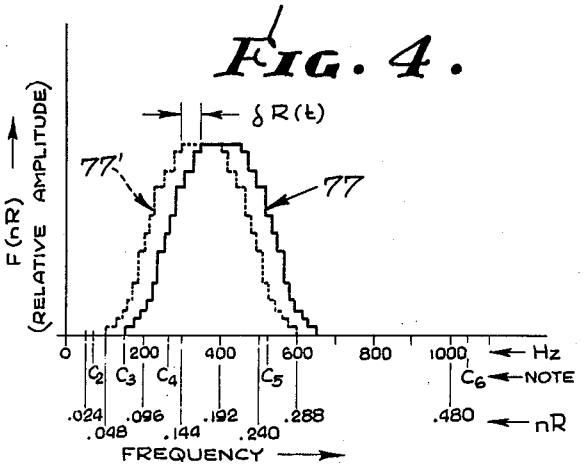
FIG. 4.
F(nR)
(RELATIVE AMPLITUDE)
δR(t)
77
77'
0
200
400
600
800
1000
Hz
$C_2$
$C_3$
$C_4$
$C_5$
$C_6$
NOTE
.024
.048
.096
.144
.192
.240
.288
.480
nR
FREQUENCY

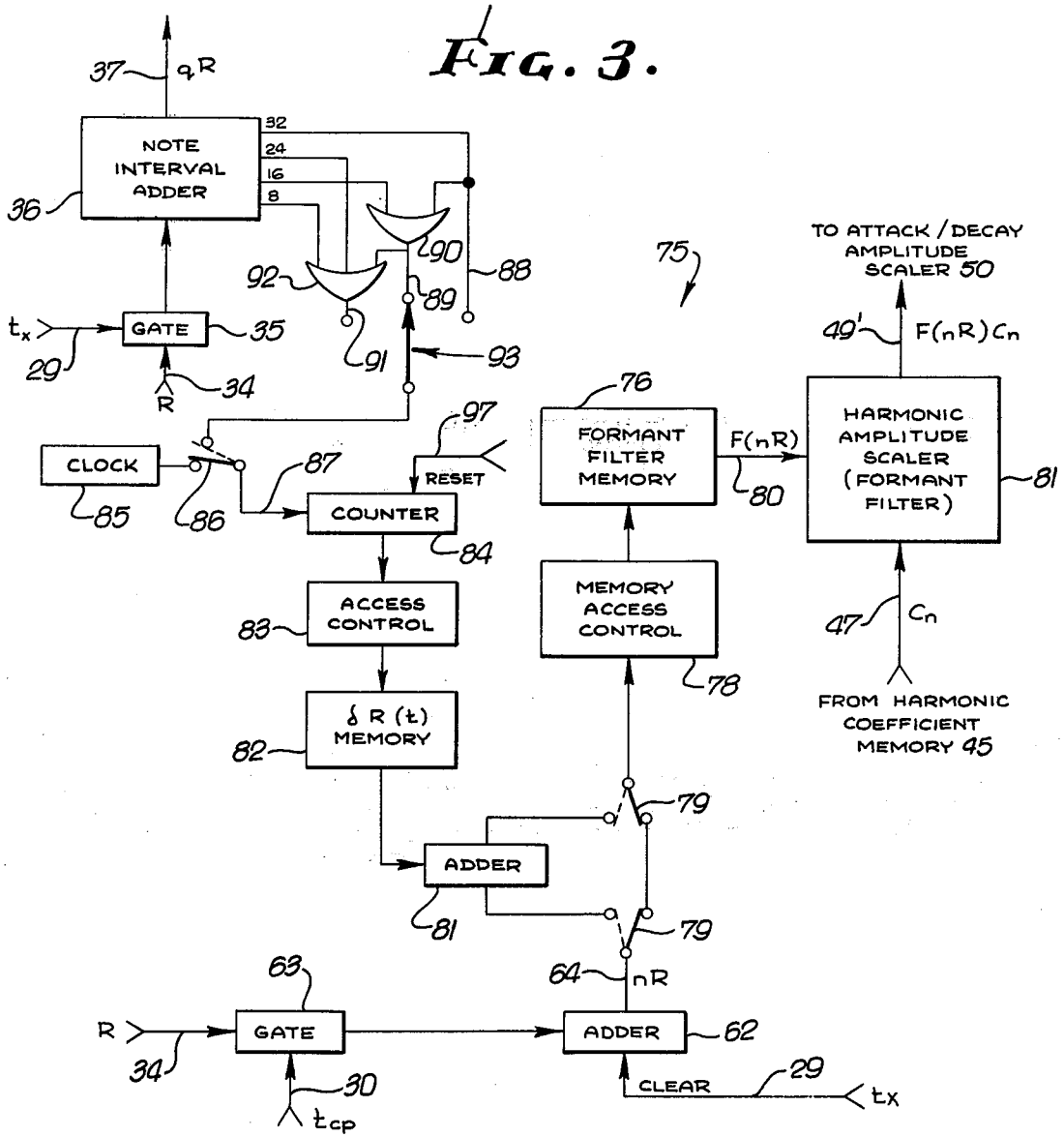
FIG. 3.
NOTE INTERVAL ADDER
36
37
$q_R$
32
24
16
8
GATE
35
34
R
$t_x$
29
88
89
90
91
92
93
97
RESET
COUNTER
84
87
86
CLOCK
85
ACCESS CONTROL
83
δR(t) MEMORY
82
ADDER
81
79
nR
64
FORMANT FILTER MEMORY
76
MEMORY ACCESS CONTROL
78
75
F(nR)
80
HARMONIC AMPLITUDE SCALER (FORMANT FILTER)
81
TO ATTACK/DECAY AMPLITUDE SCALER 50
F(nR)$C_n$
49'
$C_n$
47
FROM HARMONIC COEFFICIENT MEMORY 45
ADDER
62
CLEAR
29
$t_x$
GATE
63
30
$t_{cp}$
R
34

RELATIVE AMPLITUDE
1.2
1.1
1.0
0.9
0.8
0.7
0.6
0.5
0.4
0.3
0.2
0.1
0
M
$R_U$
121
121'
0 6 12 18 24 30 36 42 48 54 60 66
k log nR'
$C_2$ $C_3$ $C_4$ $C_5$ $C_6$ $C_7$
note (n=1, M=0)
65.4 130.8 261.6 523.2 1046.5 2093
Hz
FREQUENCY RELATIVE AMPLITUDE
1.2
1.1
1.0
0.9
0.8
0.7
0.6
0.5
0.4
0.3
0.2
0.1
0
$R_L$
$R_U$
L
M
31
32
130b'
130a'
130b
130a
0 6 12 18 24 30 36 42 48 54 60 66
k log nR'
$C_2$ $C_3$ $C_4$ $C_5$ $C_6$ $C_7$
note (n=1, M=0)
65.4 130.8 261.6 523.2 1046.5 2093
Hz
FREQUENCY RELATIVE AMPLITUDE
2.0
1.5
1.0
0.5
0
141
140
140a
140b
0 6 12 18 24 30 36 42 48 54 60 66 72 80 86
k log nR'
FREQUENCY RELATIVE AMPLITUDE
2.0
1.5
1.0
0.5
0
155
0 6 12 18 24 30 36 42 48 54 60 66
k log nR'
FREQUENCY

FORMANT FILTERING IN A COMPUTOR ORGAN

BACKGROUND OF THE INVENTION

1. Field of the Invention

The present invention relates to implementation of "formant filtering" in a computor organ by the selective attentuation or elimination of certain constituent Fourier components from the waveshape synthesis.

2. Related Patent

This application is related to the inventor's U.S. Pat. No. 3,809,786 issued May 7, 1974, entitled COMPUTOR ORGAN.

3. Description of the Prior Art

In most electronic musical instruments, a musical signal having a complete tonal spectrum is generated. Then, to achieve special effects, filters are used selectively to attentuate or eliminate certain frequency bands. For example, a band pass filter will permit all frequencies in the passband to be reproduced by the sound system, but will block signals of higher or lower frequency.

The use of such filtering in electronic musical synthesis has important applications. For example, most orchestral musical instruments exhibit tone formants. That is, a different tonal spectrum is produced for notes of different fundamental frequency. Further, the tones in certain frequency ranges may be selectively enhanced or attenuated. In a brass instrument, the different tube lengths and curvatures used for different notes causes some notes to contain accentuated harmonic components, while for other notes the same order harmonics are attenuated. Formant filters are used to synthesize such effects in electronic musical instruments.

The basic COMPUTOR ORGAN disclosed in the above referenced U.S. patent is a "sliding-formant" system in which the harmonic spectrum ideally is exactly the same for each note on the keyboard. Conventional analog frequency domain or digital time domain filters could be employed with the computor organ to limit the band of frequencies supplied to the sound system, and thereby to implement formant filtering. However, the computor organ is unique in that each individual constituent Fourier component of every note is evaluated independently. Consequently, the equivalent of formant filtering can be achieved by modifying the strength of certain Fourier components during note generation.

Thus, a principal object of the present invention is the implementation of "formant filtering" by the selective attenuation or inhibition of Fourier components in certain frequency bands during the initial tone generation, without the use of actual filters. In other words, "formant filtering" is achieved by attenuating, accentuating or eliminating from the original musical waveshape synthesis those Fourier components which lie within the undesired frequency bands. This is in contrast with the prior art approach in which a complete tonal spectrum first is generated as a waveform, and subsequently actual filters are used to attenuate or eliminate selected frequency bands.

A wide variety of special effects can be achieved using formant filtering, particularly by varying the filter characteristics as a function of time. As an example, this technique can be used to implement a "wah-wah" effect. Here, the formant filter passband is swept through the harmonic spectrum of the produced note. Typically, lower frequency components first are accentuated, followed by sliding accentuation of gradually higher frequency harmonics. This can be used to imitate a trumpet player covering and uncovering the trumpet bell with a mute.

In the past, "wah-wah" has been implemented by generating a reedtype tone which then is processed by a formant filter having a passband that can be varied electronically, e.g., in response to a foot-controlled switch. To eliminate the difficulty of coordination required to produce foot-controlled "wah-wah", some systems automatically cause the formant filter to sweep from low to high frequency, at a selectable rate, each time that a note is played. As in the general formant filtering case, such prior art "wah-wah" or other time-varying filter effects all have been produced by generating a note having a full tonal spectrum, and subsequently filtering out the selected formants. Another object of the present invention is to accomplish time-variant "formant filtering" in a computor organ by selective, time-variant attenuation or elimination of constituent Fourier components from the waveshape synthesis.

Other unique effects are achieved by accentuating certain frequencies within the formant filter passband. This accentuation may be restricted to a relatively narrow frequency range, corresponding to the resonance frequency of a fairly high Q filter. Hence a further object of this invention is to implement such "Q-resonance" accentuation in a computor organ. The Q-resonance frequency itself may be time variant.

SUMMARY OF THE INVENTION

These and other objectives are achieved in a COMPUTOR ORGAN of the type described in the above mentioned U.S. Pat. No. 3,809,786. In such an instrument, musical notes are produced by computing in real time the amplitudes $X_o(qR)$ at successive sample points $qR$ of a musical waveshape, and converting these amplitudes to tones as the computations are carried out. Each sample point amplitude is computed during a regular time interval $t_x$ according to the relationship:

$$X_o(qR) = \sum_{n=1}^{W} S(t)F(nR)C_n \sin \frac{\pi}{W} nqR \qquad \text{(Eq 1)}$$

where $q$ is an integer incremented each time interval $t_x$ and the value $n$=1,2,3 . . . W represents the order of the Fourier component being evaluated. A frequency number R establishes, and is proportional to, the fundamental frequency of the generated note. Attack and decay are governed by a time dependent scale factor $S(t)$ that defines the amplitude envelope of the produced tone. The tonal quality or "voice" of the generated note is established by a set of harmonic coefficients $C_n$ that define the relative amplitudes of the constituent Fourier components.

"Formant filtering" is achieved by selectively attenuating or eliminating from the waveshape synthesis Fourier components within selected frequency bands. To this end, the value $F(nR)$ in equation 1 is a filter scale factor representative of the "filter" characteristics. That is, the scale factor $F(nR)$ specifies the desired attenuation as a function of frequency. Advantageously the filter scale factor $F(nR)$ is given as a function of $(nR)$, which value is proportional to the frequency of the $n^{th}$ order constituent Fourier component currently being evaluated.

For a simple step filter, such as that illustrated by the curve 18 of FIG. 2, the filter scale factor may have a value $F(nR)=1$ for $R_L \leq nR \leq R_U$ where $R_L$ and $R_U$ respectively are the frequency numbers corresponding to the lower and upper cutoff frequencies of the "filter". In other words, all Fourier components within the passband 19 are evaluated at their full value. Outside the passband 19, for all values $nR<R_L$ or $nR>R_U$, the filter scale factor $F(nR)=0$. That is, all Fourier components having a frequency either above or below the passband 19 are eliminated from the waveshape amplitude computation.

The formant filter characteristics are arbitrary, and certainly not limited to the step function of FIG. 2. For example, the exemplary filter shape of FIG. 4 may be implemented by storing a corresponding set of scale factors $F(nR)$ in a formant filter memory. These are accessed in accordance with the frequency of the currently evaluated Fourier component and used to scale the harmonic coefficient $C_n$ associated with that component.

In a particularly useful embodiment of the invention, illustrated by FIGS. 5 through 12, the filter scale factors are specified as a logarithmic function of $(nR)$. This facilitates equal filter resolution for each octave, and simplifies addressing of the formant filter memories. This embodiment can be modified, as shown in FIG. 10, to implement "Q-resonance" harmonic accentuation. Here, the Fourier components being within a narrow frequency range, typically near the cutoff of the formant filter, are accentuated, as illustrated in FIGS. 11 and 12. Particularly unusual effects are achieved as the filter frequency is varied in time, since the components just entering or just leaving the passband are accentuated. Circuitry for implementing time variant "formant filters" also is disclosed.

BRIEF DESCRIPTION OF THE DRAWINGS

A detailed description of the invention will be made with reference to the accompanying drawings, wherein like numerals designate corresponding parts in the several figures.

FIG. 2 is a graph illustrating the abrupt-cutoff, bandpass filter characteristics implemented by the embodiment of FIG. 1.

FIG. 3 is an electrical block diagram of alternative formant filter circuitry useful with the computor organ of FIG. 1.

FIG. 4 shows a typical bandpass filter characteristic that can be implemented using the circuitry of FIG. 3.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

Figure 1:
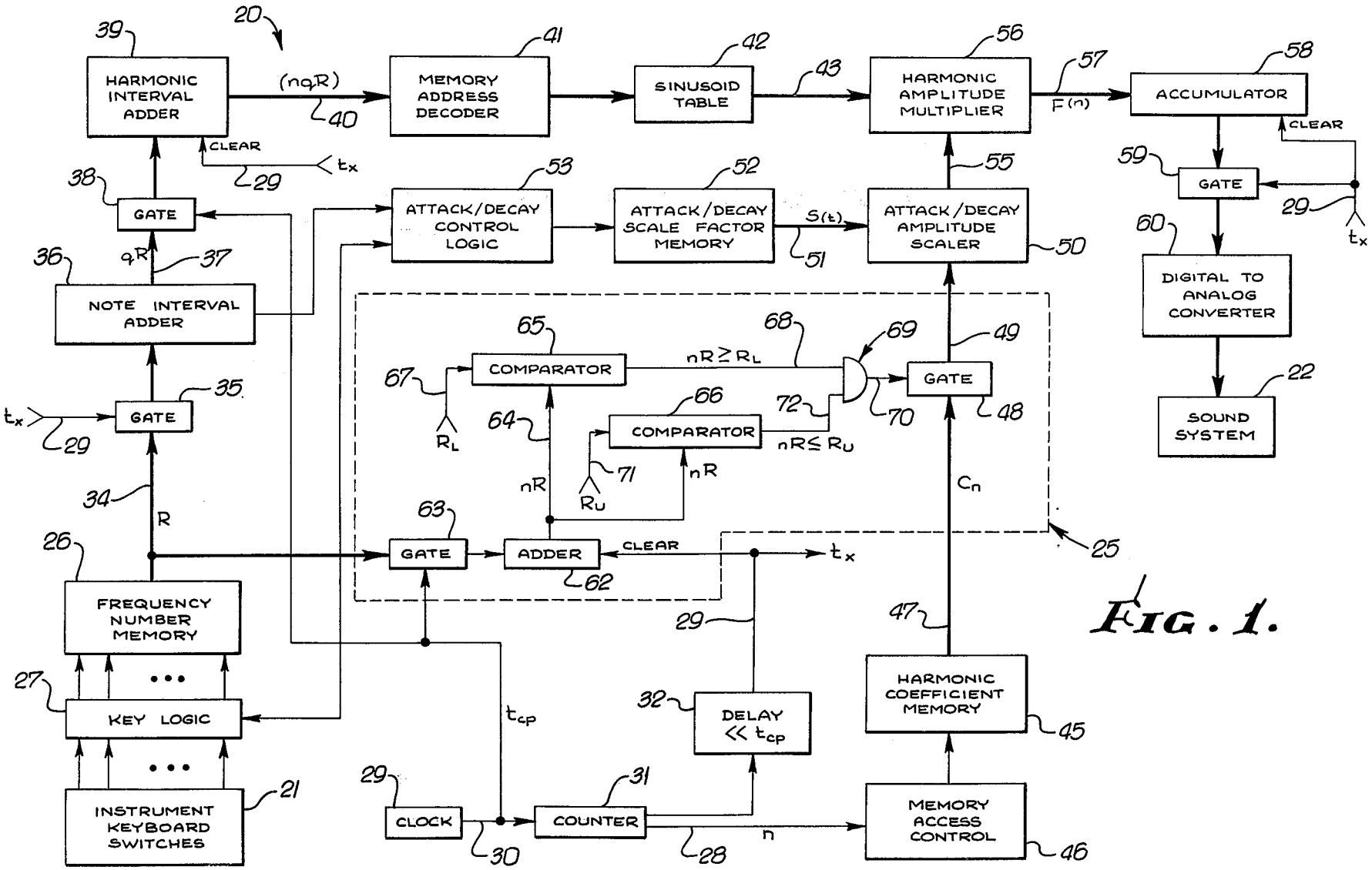
FIG. 1 is an electrical block diagram of a computor organ incorporating "formant filtering" in accordance with the present invention.

"Formant filtering" is incorporated in the basic computor organ 20 of FIG. 1. In this instrument, each time one of the keyboard switches 21 is depressed, a corresponding note is produced via a sound system 22. This is accomplished by computing the sample point amplitudes $X_o(qR)$ of a musical waveshape in accordance with equation 1 above, and converting these amplitudes to musical sounds as the computations are carried out in real time. During this operation, appropriate formant filter circuitry 25 (FIG. 1) eliminates from the waveshape computation all Fourier components having a frequency outside of a specified passband 19 (FIG. 2). In this manner, the synthesized sound is characterized by the presence of frequency components only within the passband, just as though an actual filter had been employed.

The fundamental frequency of the selected note is established by a frequency number R that is accessed from a frequency number memory 26 in response to closure of a keyboard switch 21. Key logic 27, described in conjunction with FIG. 5 below, insures that the frequency number R continues to be accessed from the memory 26 even during the note decay period subsequent to key release.

The frequency numbers R stored in the memory 26 are related to the nominal fundamental frequencies of the musical notes produced by the computor organ 20, to the computation time interval $t_x$, and to the number of amplitude sample points N for the note of highest fundamental frequency $f_H$ produced by the organ. For example, if the frequency number R for such note of highest frequency is selected as unity, then with a computation time interval $t_x$ given by $t_x = 1/Nf_H$ exactly N sample point amplitudes will be computed for that note.

The values R for notes of lower frequency readily can be ascertained, knowing that the frequency ratio of any two contiguous notes in an equally tempered musical scale is $\sqrt[12]{2}$. In general, the frequency numbers R for notes other than that of highest frequency $f_H$ will be non-integers.

By way of example, the following Table I lists the frequency and the frequency number R for each note in octaves two and six. The note $C_7$ (the key of C in octave 7) is designated as the note of highest fundamental frequency produced by the computor organ 20, and hence is assigned the frequency number R of unity. In this example, N = 32 sample points are computed for the note $C_7$, this value of N being satisfactory for adequate synthesis for an organ pipe or many other musical sounds.

TABLE I

| NOTE | FREQUENCY (Hz) | R |
|---|---|---|
| $C_7$ | 2093.00 | 1.0000 |
| $B_6$ | 1975.53 | 0.9443 |
| $A\#_6$ | 1864.66 | 0.8913 |
| $A_6$ | 1760.00 | 0.8412 |
| $G\#_6$ | 1661.22 | 0.7940 |
| $G_6$ | 1567.98 | 0.7494 |
| $F\#_6$ | 1479.98 | 0.7073 |
| $F_6$ | 1396.91 | 0.6676 |
| $E_6$ | 1318.51 | 0.6301 |
| $D\#_6$ | 1244.51 | 0.5947 |
| $D_6$ | 1174.66 | 0.5613 |
| $C\#_6$ | 1108.73 | 0.5298 |
| $C_6$ | 1046.50 | 0.5000 |
| . | | |
| . | | |
| $C_5$ | 523.25 | 0.2500 |
| . | | |
| . | | |
| $C_4$ | 261.63 | 0.1250 |
| . | | |
| . | | |
| $C_3$ | 130.81 | 0.0625 |
| $B_2$ | 123.47 | 0.0590 |
| $A\#_2$ | 116.54 | 0.0557 |
| $A_2$ | 110.00 | 0.0526 |
| $G\#_2$ | 103.83 | 0.0496 |
| $G_2$ | 97.99 | 0.0468 |
| $F\#_2$ | 92.50 | 0.0442 |
| $F_2$ | 87.31 | 0.0417 |
| $E_2$ | 82.41 | 0.0394 |
| $D\#_2$ | 77.78 | 0.0372 |
| $D_2$ | 73.42 | 0.0351 |
| $C\#_2$ | 69.30 | 0.0331 |
| $C_2$ | 65.40 | 0.0312 |

In the embodiment of FIGS. 1 and 2, the lower and upper cutoff frequencies of the formant filter passband advantageously are specified in terms of frequency numbers $R_L$ and $R_U$. For example, if the lower cutoff frequency $R_L$=0.60, corresponding to a frequency of about 125.9 Hz, then the fundamental component of the note $B_2$ (R=0.059) would lie outside the passband, but the fundamental of the note $C_3$ (R=0.625) is within the passband.

The frequency of each higher order ($n \geq 2$) Fourier component is specified by the value ($n$R). For example, the second order ($n$=2) component of the note $C_2$ has a frequency $nR=2R_{(C_2)}=2(0.3125)=0.625$. (Of course, this corresponds to the frequency number for the note $C_3$, the fundamental frequency of which is the same as the second harmonic of $C_2$.) As described below, the formant filter circuitry 25 evaluates the frequency number $n$R associated with the Fourier component presently being evaluated. If this value $n$R lies within the passband, the corresponding Fourier component is included in the waveshape amplitude computation. If not, the component is eliminated from the computation.

In the computor organ 20 (FIG. 1) the individual Fourier components $F^{(n)}$ are individually evaluated during successive calculation time intervals $t_{cp1}$ through $t_{cp16}$. . At each such interval the corresponding value $n$ is present on a line 28. A clock 29 supplies pulses at intervals $t_{cp}$ via a line 30 to a counter 31 of modulo W. The contents of the counter 31 designates the order $n$ and provides the signals on the line 28. A computation interval $t_x$ timing pulse is provided on a line 29 by slightly delaying the counter 31 reset pulse (which occurs at time $t_{cp16}$) in a delay circuit 32.

At the beginning of each computation interval $t_x$, the frequency number R, provided via a line 34 and a gate 35, is added to the previous contents of a note interval adder 36. Thus the contents of the adder 36, supplied via a line 37, represents the value ($q$R) designating the waveshape sample point currently being evaluated. Preferably the note interval adder 36 is of modulo 2W, where W is the highest order Fourier component evaluated by the instrument 20.

Each calculation timing pulse $t_{cp}$ is supplied via the line 30 to a gate 38. This gate 38 provides the value $q$R to a harmonic interval adder 39 which is cleared at the end of each amplitude computation interval $t_x$. Thus the contents of the harmonic interval adder 39 is incremented by the value ($q$R) at each calculation interval $t_{cp1}$ through $t_{cp16}$, so that the contents of the adder 39 represents the quantity ($nq$R). This value is available on a line 40.

An address decoder 41 accesses from a sinusoid table 42 the value $$\sin \frac{\pi}{W} nqR$$

corresponding to the argument $nq$R received via the line 40. The sinusoid table 42 may comprise a read only memory storing values of $$\sin \frac{\pi}{W}$$

for $0 \leq \phi \leq W/2$ at intervals of D, where D is called the resolution constant of the memory. With this arrangement, the value $$\sin \frac{}{W} qR$$

will be supplied on a line 43 during the first calculation interval $t_{cp1}$. During the next interval $t_{cp2}$, the value $$\sin \frac{\pi}{W} 2qR$$

will be present on the line 43. Thus in general the value $$\sin \frac{\pi}{W} nqR$$

will be provided from the sinusoid table 42 for the particular $n^{th}$ order component specified by the contents of the counter 31.

A set of harmonic coefficients $C_n$ is stored in a harmonic coefficient memory 45. As each sinusoid value is supplied on the line 43, the harmonic coefficient $C_n$ for the corresponding $n^{th}$ order component is accessed from the memory 45 by a memory address control circuit 46 which receives the value $n$ from the line 28. The accessed value $C_n$ is supplied via a line 47 to a gate 48 included in the formant filter circuitry 25. If the Fourier component currently being evaluated lies within the formant filter passband, the gate 48 will be enabled. In this instance, the harmonic coefficient $C_n$ will be provided via the enabled gate 48 and a line 49 to an attack/decay amplitude scaler 50. If the currently evaluated component lies outside the filter passband, the gate 48 will be disabled. In effect, a zero-valued signal will will be provided to the scaler 50, so that the component will make no contribution to the computed waveshape amplitude.

The scaler 50 multiplies the harmonic coefficient $C_n$ supplied on the line 49 by an attack/decay scale factor $S(t)$ that establishes the waveshape amplitude envelope during attack, sustain and decay. This value $S(t)$ is provided on a line 51 from an attack/decay scale factor memory 52 accessed by appropriate control logic 53.

The product provided from the scaler 50 via a line 55 is multiplied by the value $$\sin \frac{\pi}{W} nqR$$

on the line 43 in a harmonic amplitude multiplier 56. The output of the multiplier 56, corresponding to the value:

$$F^{(n)} = S(t)F(nR)C_n \sin \frac{\pi}{W} nqR$$

of the Fourier component presently being evaluated, is supplied via a line 57 to an accumulator 58. The Fourier components thus evaluated are summed in the accumulator 58. Thus at the end of each computation time interval $t_x$ the contents of the accumulator 58 represents the waveshape amplitude $X_o(qR)$ for the current sample point $qR$. Occurrence of the $t_x$ pulse transfers the contents of the accumulator 58 via a gate 59 to a digital-to-analog converter 60. The accumulator 58 then is cleared in preparation for summing of the Fourier components associated with the next sample point, computation of which begins immediately.

The digital-to-analog converter 60 supplies to the sound system 22 a voltage corresponding to the waveshape amplitude just computed. Since these computations are carried out in real time, the analog voltage supplied from the converter 60 comprises a musical waveshape having a fundamental frequency established by the frequency number R then being supplied from the memory 26. However, the synthesized musical waveshape contains only Fourier components lying within the formant filter passband 19 (FIG. 2) extending between the lower cutoff frequency $R_L$ and the upper cutoff frequency $R_U$.

To accomplish such formant filtering, the circuitry 25 (FIG. 1) includes an adder 62 used to obtain the value $n$R proportional to the frequency of the Fourier component currently being evaluated. As each successive Fourier component calculation takes place, the timing pulse $t_{cp}$ present on the line 30 enables a gate 63 to provide the current frequency number R from the line 34 to the added to the previous contents of the adder 62. The adder 62 itself is cleared at the end of each waveshape amplitude computation interval $t_x$, so that the cumulative contents of the adder 62 corresponds to the value $n$R.

The value $n$R is supplied from the adder 62 via a line 64 to a pair of comparators 65, 66. In the comparator 65, the value $n$R is compared to a signal representing the "formant filter" lower cutoff frequency $R_L$ provided via a line 67. If $nR \geq R_L$, the comparator 65 provides an output signal via a line 68, an AND gate 69 and a line 70 to the enable input of the gate 48. Similarly, the comparator 66 compares the value $n$R with a signal indicative of the upper cutoff frequency $R_U$ supplied on a line 71. If $nR \leq R_U$, the comparator 66 provides a signal on a line 72 to the second input of the AND gate 69. If both inputs to this AND gate 69 are high, the resultant signal on the line 70 enables the gate 48 to provide the harmonic coefficient $C_n$ from the line 47 to the attack/decay amplitude scaler 50. This only occurs when the frequency of the Fourier component currently being evaluated lies within the "formant filter" passband. If $nR>R_L$ or $nR>R_U$, one or the other of the inputs to the AND gate 69 will be low, and the gate 48 will be inhibited. As a result, a zero value will be supplied to the scaler 50, so that the currently evaluated Fourier component will make no contribution to the waveshape sample point amplitude currently being summed in the accumulator 58. In effect, those Fourier components which lie outside the passband will be eliminated from the waveshape synthesis.

A "bandpass filter" thus is implemented by the circuitry 25. If only a high pass filter function is desired, this can be implemented merely by eliminating the comparator 66, and providing the signal on the line 68 directly to the enable input of the gate 48. With such arrangement, any Fourier component having a frequency $nR \geq R_L$ will be included in the waveshape amplitude computation, since the corresponding output from the comparator 65 will enable the gate 48. Similarly, to implement a low pass filter, the comparator 65 is deleted and the output of the comparator 66 connected directly to the enable input of the gate 48. In this way, each time $nR \leq R_U$ the comparator 66 will provide the corresponding harmonic coefficient $C_n$ to the attack/decay amplitude scaler 50.

The alternative formant filter circuitry 75 shown in FIG. 3 can implement a Fourier filter of arbitrary shape. To this end, the circuitry 75 includes a formant filter memory 76 which stores a set of filter scale factors $R(nR)$ that effectively define the filter passband. The shape of this passband is arbitrary, but is typified by the waveshape 77 of FIG. 4. The filter scale factors are stored in memory locations associated with particular frequency number values $n$R. A greater or lesser number of such scale factors may be stored in the memory 76 depending on the desired resolution of the filter characteristics.

Filter scale factors $F(nR)$ are accessed from the memory 76 by a control circuit 78 that receives the value $n$R from the adder 62 via the line 64 and a switch 79 set to the position shown in FIG. 3. The access control 78 causes the corresponding scale factor $F(nR)$ to be provided via a line 80 to a harmonic amplitude scaler 81. This circuit 81 multiplies the harmonic coefficient $C_n$ present on the line 47 by the filter scale factor, and provides the product $F(nR)C_n$ via a line 49' to the attack/decay amplitude scaler 50. In this manner, each constituent Fourier component is scaled in amplitude by an amount established by the desired formant filter shape, such as that illustrated in FIG. 4.

Time variation of the formant filter passband may be implemented by the circuitry actuated when the switch 79 is set to the position shown in broken lines in FIG. 3. In that configuration, an adder 81 adds to the current value $n$R an amount $\delta R(t)$ which effectively offsets in frequency the formant filter passband by a corresponding amount. For example, the bandpass curve 77 (FIG. 4) would be shifted downward in frequency by an amount $\delta R(t)$ as shown by the curve 77'.

A set of values $\delta R(t)$ are stored in a memory 82. At different times, different ones of these values are accessed from the memory 82 by an access control circuit 83 responsive to the contents of a counter 84. The counter 84 may receive timing pulses from a clock 85 via a switch 86 and a line 87. With such arrangement, the formant filter waveshape 77 (FIG. 4) will be shifted by selected amounts $\delta R(t)$ that vary in time depending on the contents of the counter 84.

For example, the counter 84 may automatically reset upon reaching a certain count. Thus the set of values $\delta R(t)$ stored in the memory 82 will be accessed repetitively at a rate established by the clock 85. These values $\delta R(t)$ may be selected to shift the waveshape 77 first in one direction (e.g., lower in frequency) and then back in the other direction, so that the formant filter passband will be shifted up and down periodically. Alternatively, the counter 85 may count up to a certain value and then be reset, e.g., by the "key depressed" signal on the line 97 that occurs only when a new note is selected on the keyboard switches 21. In such case the formant filter passband will be shifted through a frequency vs. time cycle established by the stored values $\delta R(t)$, once each time that a note is selected. Other variations may be employed.

The rate at which different values $\delta R(t)$ are accessed from the memory 82, and hence the rate at which the formant filter passband is varied, may be made dependent upon which note has been selected. One way that this can be implemented is by advancing the counter 84 each time that a cycle of fractional cycle of the selected note has been generated. To this end, when the switch 86 is set to the position shown by broken lines in FIG. 3, the counter 84 will be advanced in response to the contents of the note interval adder 36.

Since the adder 36 is of modulo 2W, it will reset each time its contents just exceeds 2W=32 (in the case where W=16 Fourier components are evaluated). This occurs upon completion of each cycle of the note being generated. Thus a signal will occur on a line 88 once for each such cycle. Similarly, at each half-cycle of the generated note, a signal will occur on a line 89 from an OR gate 90 that receives inputs when the adder 36 reaches a count of 16 or 32. A pulse each quarter cycle of the generated note occurs on a line 91 from an OR gate 92 that receives inputs when the adder 36 reaches a count of 8, 16, 24 or 32. A switch 93 is used to connect one of the lines 88, 89 or 91 to the input of the counter 84, and hence to select whether the formant filter passband is shifted each full, half or quarter cycle of the generated note.

The key logic 27 (FIG. 5) includes a set of flip-flops 94 associated with respective ones of the keyboard switches 21. Thus when the keyboard switch 21-0 associated with the note $C_2$ is depressed, the corresponding flip-flop 94-0 is set. As a result, the 1 output from the flip-flop 94-0, supplied via a line 95 to the memory 26, causes the frequency number associated with the note $C_2$ to be accessed from that memory and supplied on the line 34. The flip-flop 94-0 remains set after the keyboard switch 21-0 is released, so that the frequency $R_{(C_2)}$ will continue to be provided on the line 34 during the note decay interval. At the end of decay, a signal provided on a line 96 from the attack/decay control logic 53 causes the flip-flop 94-0 to be reset, terminating supply of the frequency number $R_{(C_2)}$ from the memory 26. A like flip-flop 94-1 through 94-60 is associated with each of the other keyboard switches 21-1 through 21-60.

Whenever any keyboard switch 21 is closed, a "key depressed" pulse is provided on a line 97. This signal is derived by an OR gate 99 that receives an input from each of the keyboard switches 21. Upon closure of any switch 21, the gate 99 provides an output that triggers a one-shot multivibrator 98 which provides the signal on the line 97. This "key depressed" signal is supplied to the attack/decay control logic 53 where it is used to initiate readout of the attack scale factors from the memory 52.

When a selected switch 21 is released, the output from the OR gate 99 goes low. This output is inverted by an inverter 100 to trigger a one shot multivibrator 101 that provides a "start of decay" signal on a line 102. This signal is supplied to the control logic 53 to initiate readout of the decay scale factors from the memory 52.

In the embodiment of FIGS. 3 and 4, the formant filter factors $F(nR)$ stored in the memory 76 and used to define the filter waveshapes 77 are specified directly in terms of the component frequency number ($n$R). Since this is non-logarithmic, there may be unequal resolution at low and high frequencies.

Figure 5:
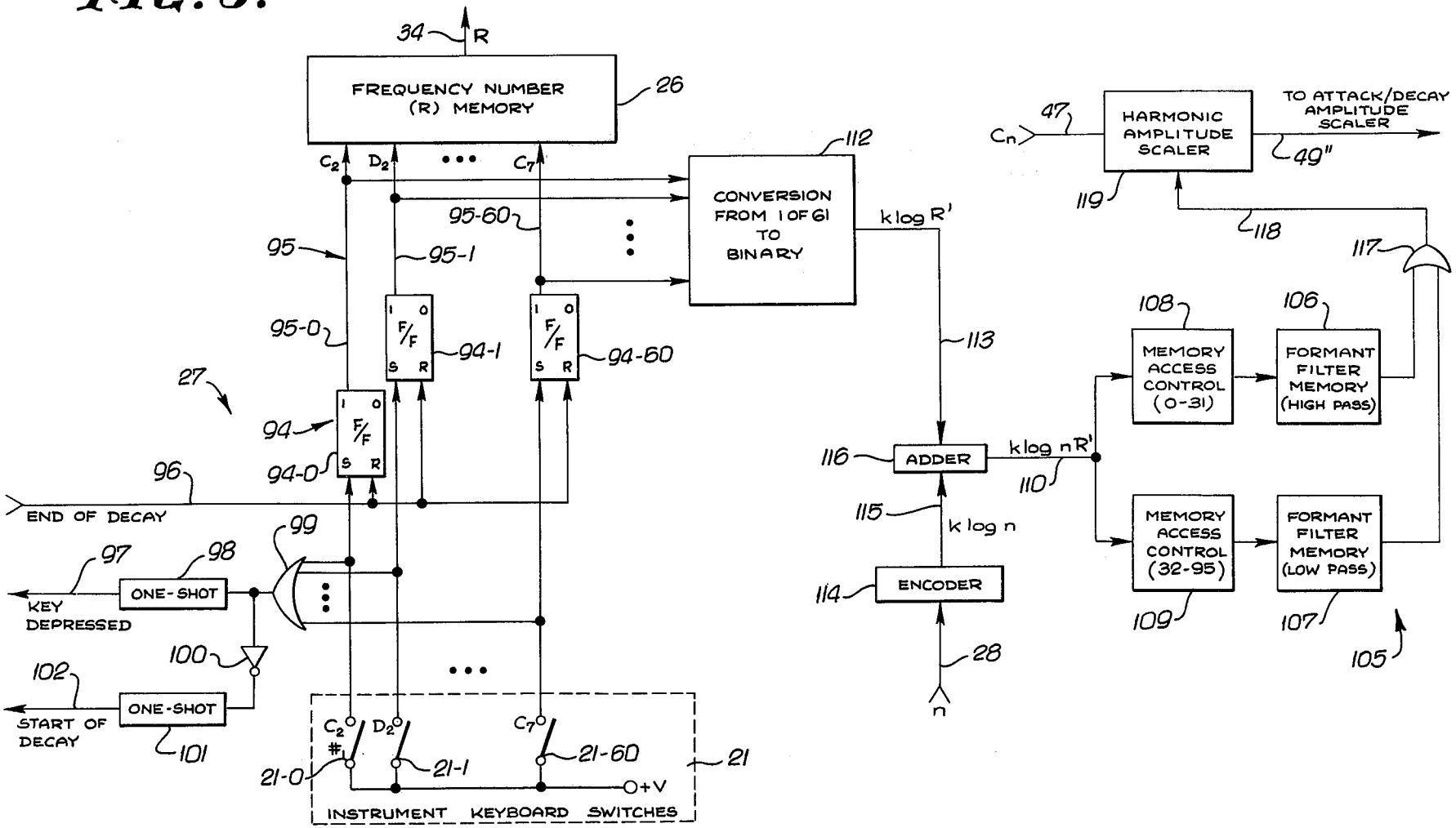
FIG. 5 is an electrical block diagram of formant filter circuitry, useful with the computor organ of FIG. 1, in which the filter scale factors are accessed as a logarithmic function of the frequency number.

By contrast, the formant filtering circuitry 105 of FIG. 5 uses filter factors that are logarithmically related to the component frequency $n$R. As a result, equal resolution can be achieved in all octaves. This distinction can be appreciated by comparing FIGS. 4 and 6. The latter figures shows a typical low pass formant filter waveshape implemented by the circuitry 105 of FIG. 5, using logarithmic resolution. An equal number of formant filter factors readily can be provided for each octave, as compared with the decreasing resolution in lower octaves illustrated by FIG. 4.

In the preferred embodiment of FIG. 5, the formant filter factors are stored in a pair of memories 106, 107 that are accessed by respective control circuits 108 and 109. Advantageously, but not necessarily, the same number of formant filter factors or data points are stored in the memories 106, 107 for each octave. These formant filter factors may be addressed by the logarithmic value $k \log nR'$ wherein R'=32R and $k$ is an arbitrary constant that is selected for ease in implementing the system. The value $k \log nR'$ is provided to the control units 108, 109 via a line 110.

For example, in an instrument having a range from $C_2$ through $C_7$, there are 61 selectable notes (i.e., 12 notes per octave for the five octaves from $C_2$ through $C_6$, plus $C_7$). Advantageously, $k$ is selected so that $k \log R'_{(C_2)}=0$ and $k \log R'_{(C_7)}=60$. With this arrangement, $k \log R'$ has an integral value of 0 through 60 corresponding to the consecutive numbering (21-0 through 21-60) of the instrument keyboard switches 21 (FIG. 5).

The value $k$ can be determined by recalling from Table I that the frequency number R for the note $C_2$ is 0.0312 and for $C_7$ is 1.0000. Thus $R'_{(C_2)}=1$ and $R'_{(C_7)}=32$. Accordingly, $$K = \frac{60}{\log R'_{(C7)}} = \frac{60}{\log 32} = 39.86$$

which value is used to compile the following Tables II and III that list the binary values for $k \log R'$ and $k \log n$.

TABLE II

| Note | R' | k log R' Binary | k log R' Decimal | Note | R' | k log R' Binary | k log R' Decimal |
|---|---|---|---|---|---|---|---|
| $C_2$ | 1.000 | 000000 | 0 | $G_4$ | 5.993 | 011111 | 31 |
| $C\#_2$ | 1.059 | 000001 | 1 | $G\#_4$ | 6.349 | 100000 | 32 |
| $D_2$ | 1.122 | 000010 | 2 | $A_5$ | 6.727 | 100001 | 33 |
| $D\#_2$ | 1.189 | 000011 | 3 | $A\#_5$ | 7.127 | 100010 | 34 |
| $E_2$ | 1.259 | 000100 | 4 | $B_5$ | 7.559 | 100011 | 35 |
| $F_2$ | 1.334 | 000101 | 5 | $C_5$ | 8.000 | 100100 | 36 |
| $F\#_2$ | 1.414 | 000110 | 6 | $C\#_5$ | 8.475 | 100101 | 37 |
| $G_2$ | 1.498 | 000111 | 7 | $D_5$ | 8.979 | 100110 | 38 |
| $G\#_2$ | 1.587 | 001000 | 8 | $D\#_5$ | 9.513 | 100111 | 39 |
| $A_3$ | 1.681 | 001001 | 9 | $E_5$ | 10.079 | 101000 | 40 |
| $A\#_3$ | 1.781 | 001010 | 10 | $F_5$ | 10.678 | 101001 | 41 |
| $B_3$ | 1.887 | 001011 | 11 | $F\#_5$ | 11.313 | 101010 | 42 |
| $C_3$ | 2.000 | 001100 | 12 | $G_5$ | 11.986 | 101011 | 42 |
| $C\#_3$ | 2.118 | 001101 | 13 | $G\#_5$ | 12.699 | 101100 | 44 |
| $D_3$ | 2.244 | 001110 | 14 | $A_6$ | 13.454 | 101101 | 45 |
| $D\#_3$ | 2.378 | 001111 | 15 | $A\#_6$ | 14.254 | 101110 | 46 |
| $E_3$ | 2.519 | 010000 | 16 | $B_6$ | 15.101 | 101111 | 47 |
| $F_3$ | 2.669 | 010001 | 17 | $C_6$ | 16.000 | 110000 | 48 |
| $F\#_3$ | 2.828 | 010010 | 18 | $C\#_6$ | 16.951 | 110001 | 49 |
| $G_3$ | 2.996 | 010011 | 19 | $D_6$ | 17.959 | 110010 | 50 |
| $G\#_3$ | 3.174 | 010100 | 20 | $D\#_6$ | 19.027 | 110011 | 51 |
| $A_4$ | 3.363 | 010101 | 21 | $E_6$ | 20.158 | 110100 | 52 |
| $A\#_4$ | 3.563 | 010110 | 22 | $F_6$ | 21.357 | 110101 | 53 |
| $B_4$ | 3.775 | 010111 | 23 | $F\#_6$ | 22.627 | 110110 | 54 |
| $C_4$ | 4.000 | 011000 | 24 | $G_6$ | 23.972 | 110111 | 55 |
| $C\#_4$ | 4.237 | 011001 | 25 | $G\#_6$ | 25.398 | 111000 | 56 |
| $D_4$ | 4.489 | 011010 | 26 | $A_7$ | 26.908 | 111001 | 57 |
| $D\#_4$ | 4.756 | 011011 | 27 | $A\#_7$ | 28.508 | 111010 | 58 |
| $E_4$ | 5.039 | 011100 | 28 | $B_7$ | 30.203 | 111011 | 59 |
| $F_4$ | 5.339 | 011101 | 29 | $C_7$ | 32.000 | 111100 | 60 |

TABLE III

| n | k log n Binary | k log n Decimal |
|---|---|---|
| 1 | 0000000 | 0 |
| 2 | 0001100 | 12 |
| 3 | 0010011 | 19 |
| 4 | 0011000 | 24 |
| 5 | 0011100 | 28 |
| 6 | 0011111 | 31 |
| 7 | 0100010 | 34 |
| 8 | 0100100 | 36 |
| 9 | 0100110 | 38 |
| 10 | 0101000 | 40 |
| 11 | 0101010 | 42 |
| 12 | 0101011 | 43 |
| 13 | 0101100 | 44 |
| 14 | 0101110 | 46 |
| 15 | 0101111 | 47 |
| 16 | 0110000 | 48 |

The foregoing scheme readily is implemented as shown in FIG. 5. When a note is selected by closure of a keyboard switch 21, a 1 output from the corresponding flip-flop 94 is provided on a respective one of the lines 95-0 through 95-60. These 61 lines 95 are connected to a conversion circuit 112 which provides a binary output on a line 113 that corresponds to the identity of the one input line 95 on which a signal occurs. For example, if the note $D_2$ is selected by closing the switch 21-1, a signal is provided on the line 95-1 to the conversion circuit 112. The binary value 000001 is provided on the line 113 which, as indicated by Table II, corresponds to the value $k \log R'$ for the selected note $D_2$.

The order $n$ of the Fourier component currently being evaluated is provided via the line 28 to an encoder 114. This encoder 114 provides on a line 115 a binary signal of the value $k \log n$ corresponding to the value n provided on the line 28. The value $k \log R'$ on line 113 is added to the value $k \log n$ on the line 115 by an adder 116. The sum $k \log nR'$ obtained by the adder 116 is supplied on the line 110 to the control circuits 108, 109 that access the corresponding formant filter factor from the memory 106 or 107. The accessed formant filter factor is supplied via an OR gate 117 and a line 118 to a harmonic amplitude scaler 119. There, the harmonic coefficient $C_n$ present on the line 47 is multiplied by the formant filter factor $F(nR)$ supplied on the line 118. The product $C_nF(nR)$ is supplied via a line 49'' to the attack/decay amplitude scaler 50.

The entire set of factors defining a complete formant filter waveshape could be stored in a single memory that is accessed in response to the value $k \log nR'$ present on the line 10. However, independent control of the upper and lower cut-off frequencies, and hence of the passband, advantageously is achieved by storing the high pass formant filter factors in one memory 106, and having the low pass formant filter factors stored in another memory 107.

Figure 6:
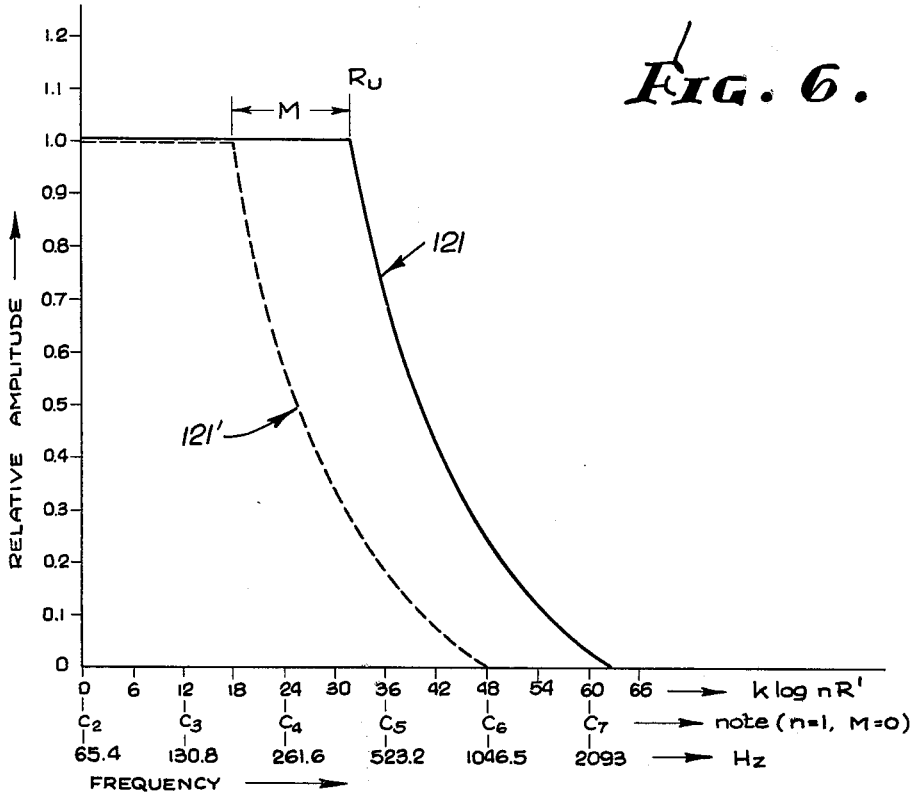
FIG. 6 is a graph showing a typical low pass filter function that can be implemented using the circuitry of FIG. 5.

By way of example, the memory 107 may contain filter factors defining the low pass filter waveshape 121 shown in FIG. 6. Arbitrarily, the upper cut-off frequency $R_U$ is selected as the value $k \log nR'=32$. Correspondingly, the memory access conrol 109 is responsive to values of $k \log nR'$ of 32 or greater. Typical relative amplitude and db attenuation values for the low pass filter formant factors are listed in the following Table IV.

TABLE IV

| k log nR' | Relative Amplitude | db Attenuation |
|---|---|---|
| 32 | 1.000 | 0 |
| 33 | .890 | 1 |
| 34 | .795 | 2 |
| 35 | .715 | 3 |
| 36 | .635 | 4 |
| 37 | .555 | 5 |
| 38 | .507 | 6 |
| 39 | .445 | 7 |
| 40 | .397 | 8 |
| 41 | .345 | 9 |
| 42 | .317 | 10 |
| 43 | .286 | 11 |
| 44 | .254 | 12 |
| 45 | .222 | 13 |
| 46 | .206 | 14 |
| 47 | .174 | 15 |
| 48 | .159 | 16 |
| 49 | .143 | 17 |
| 50 | .127 | 18 |
| 51 | .112 | 19 |
| 52 | .095 | 20 |
| 53 | .095 | 20 |
| 54 | .079 | 22 |
| 55 | .063 | 23 |
| 56 | .063 | 23 |
| 57 | .000 | greater than 50 |
| . | . | . |
| . | . | . |
| . | . | . |
| 95 | .000 | greather than 50 |

Of course, the formant filter factor values stored in the memories 106 and 107 are matters of design choice and are completely arbitrary.

Figure 7:
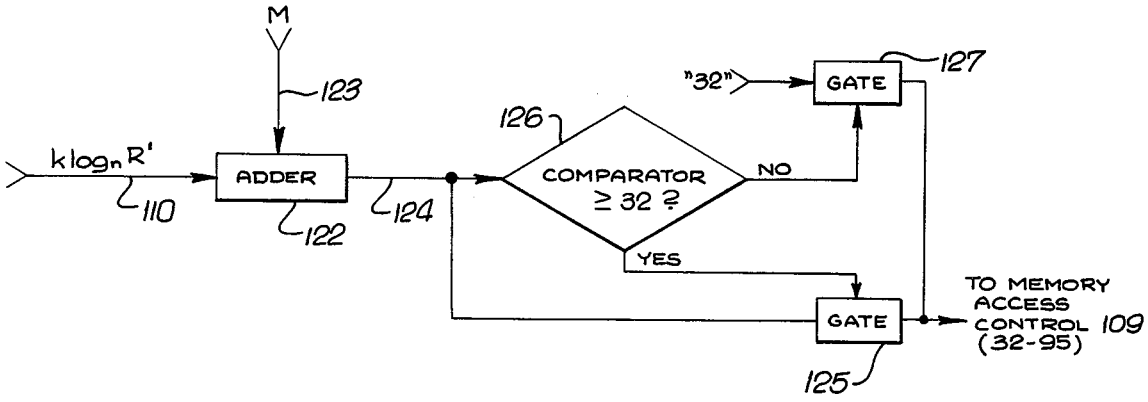
FIG. 7 is an electrical block diagram of a modification to the circuit of FIG. 5 to facilitate shifting of the filter cutoff frequency.

FIGS. 6 and 7 illustrate the manner in which the upper cut-off frequency $R_U$ can be changed in response to a control signal. Advantageously, the control signal is an integer M corresponding to the difference value $\Delta k \log nR'$ designating the amount by which $R_U$ is to be raised or lowered in frequency. For example, if the cut-off frequency is to be lowered from $k \log nR'=32$ to $k \log nR'=18$, then $M=(32-18)=14$. Addition of this integer M to the value $k \log nR'$ provided on the line 110 will have the effect of shifting the low pass filter waveshape 121 lower in frequency, as indicated by the broken line 121' of FIG. 6.

This is implemented by an adder 122 (FIG. 7) that sums the value $k \log nR'$ from the line 110 with the value M received on a line 123. The supplied integer M may be of fixed value, may be operator selected, or may be time variant so that the resultant formant filter characteristics correspondingly vary in time. The sum from the adder 122 is supplied via a line 124 and a gate 125 to the appropriate memory access control 109. If the value $(k \log nR')$-M is less than 32, a comparator 126 enables a gate 127 that supplies the value 32 to the memory 109 so that the maximum stored formant filter factor (typically $F(nR)=1$) is supplied to the scaler 119.

Figure 9:
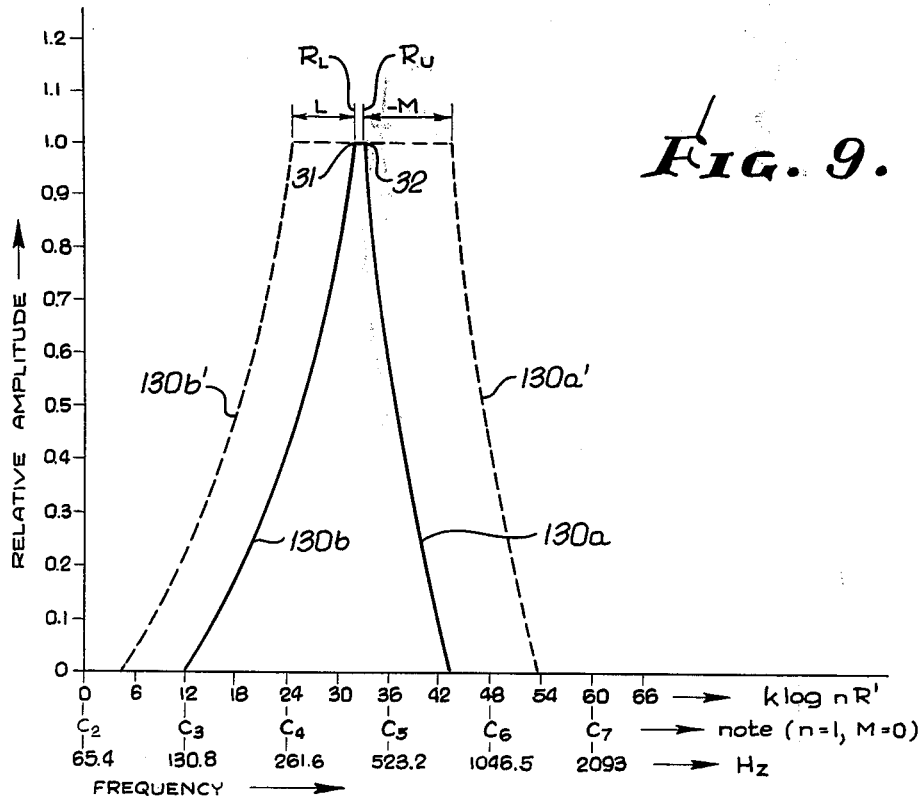
FIG. 9 is a graph illustrating the bandwidth modification implemented by the circuit of FIG. 8.
Figure 8:
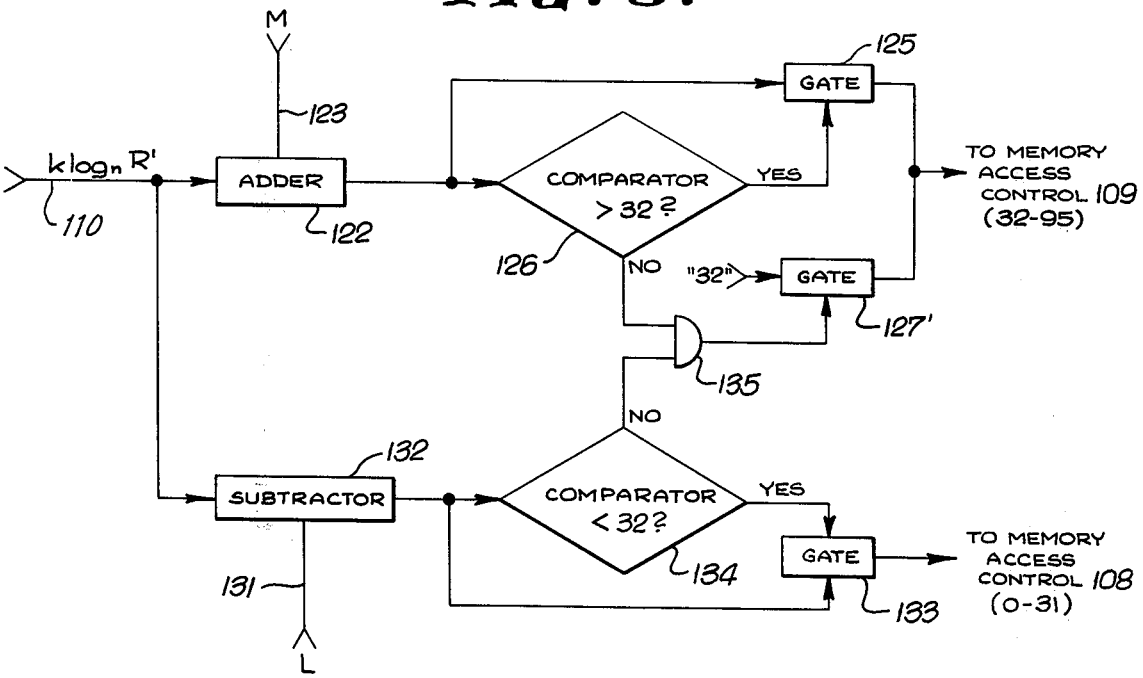
FIG. 8 is an electrical block diagram of another modification to the circuit of FIG. 5, which permits implementation of a bandpass filter function of selectable bandwidth and cutoff frequencies.

A bandpass formant filter in which the upper and lower cut-off frequencies independently may be varied is illustrated by FIGS. 8 and 9. The low pass characteristics represented by the waveshape 130a are stored in the memory 107, and the high pass characteristics represented by the waveshape **130*b* are stored in the memory 106.**

The upper cut-off frequency $R_U$ can be shifted upward in frequency to the position shown by the broken line **130*a'* of FIG. 9 by adding an integer -M to the value $k \log nR'$ supplied on the line 110. Similarly, the high pass waveshape 130b can be shifted downward in frequency, as to the position 130*b'* (FIG. 9**), by subtracting from the value $k \log nR'$ an integer L that specifies the desired shift in the lower cut-off frequency $R_L$.

The value L is supplied via a line 131 (FIG. 8) to a subtractor circuit 132. The difference $(k \log nR')$ - L is supplied via a gate 133 to the memory access control circuit 109, so long as the value of this difference is less than 32. Under this condition, a comparator 134 enables the gate 133.

Since the upper and lower cut-off frequencies are being shifted independently, there will be a frequency range between the values $R_L$ and $R_U$ within which the Fourier components are not to be attenuated. For a component in this range, both the comparators 126 and 134 will provide outputs to an AND gate 135 which enables a gate 127' that provides the value $k \log nR' = 32$ to the memory access control 109. This will cause the corresponding formant filter factor to be accessed from the memory 109. Preferably, but not necessarily, this value will be unity, so that in the passband between $R_L$ and $R_U$ the generated Fourier components will not be attenuated.

Figure 10:
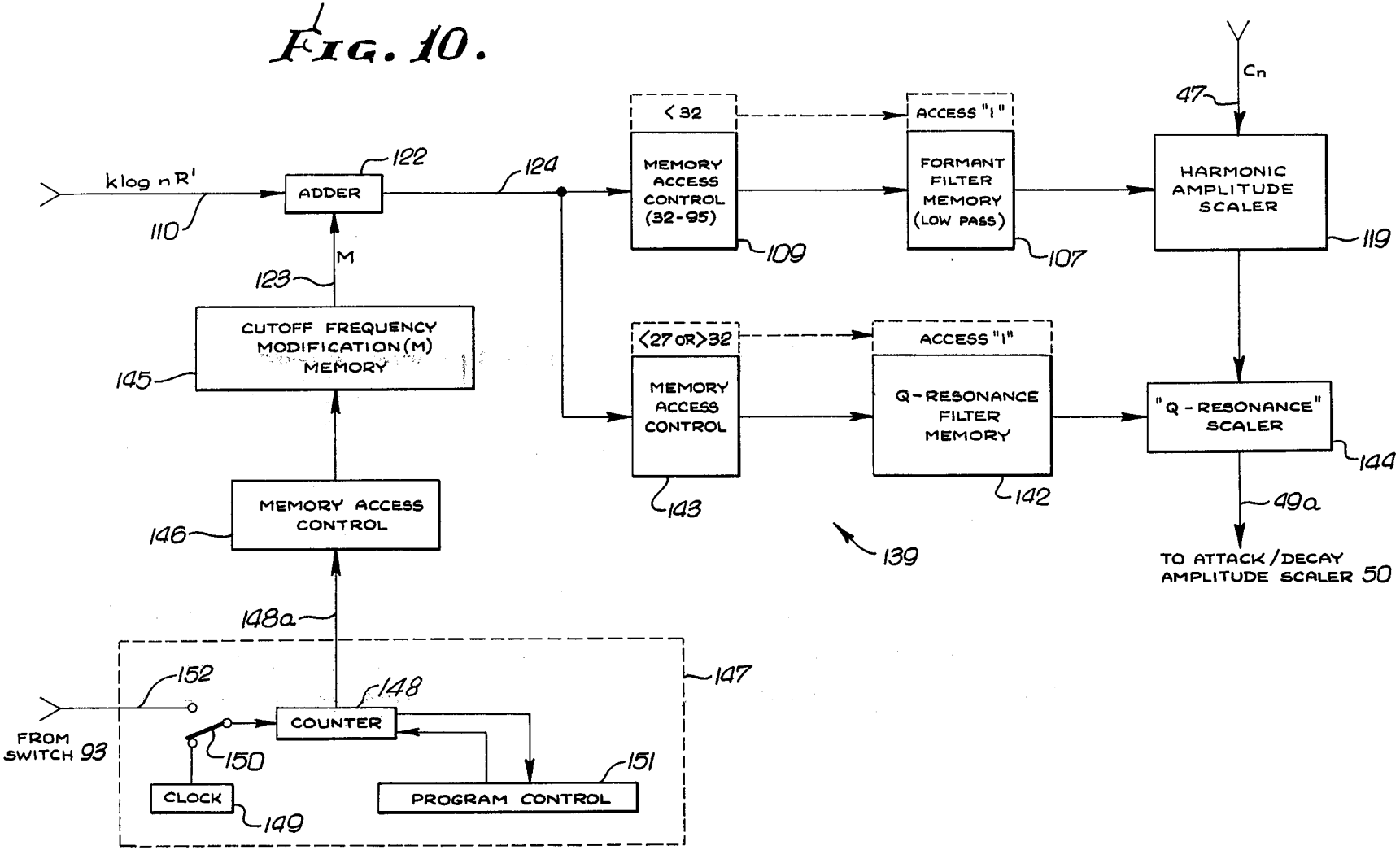
FIG. 10 is an electrical block diagram of circuitry useful for implementing a Q-resonance formant filter function in conjunction with the circuitry of FIGS. 1 and 5.
Figure 11:
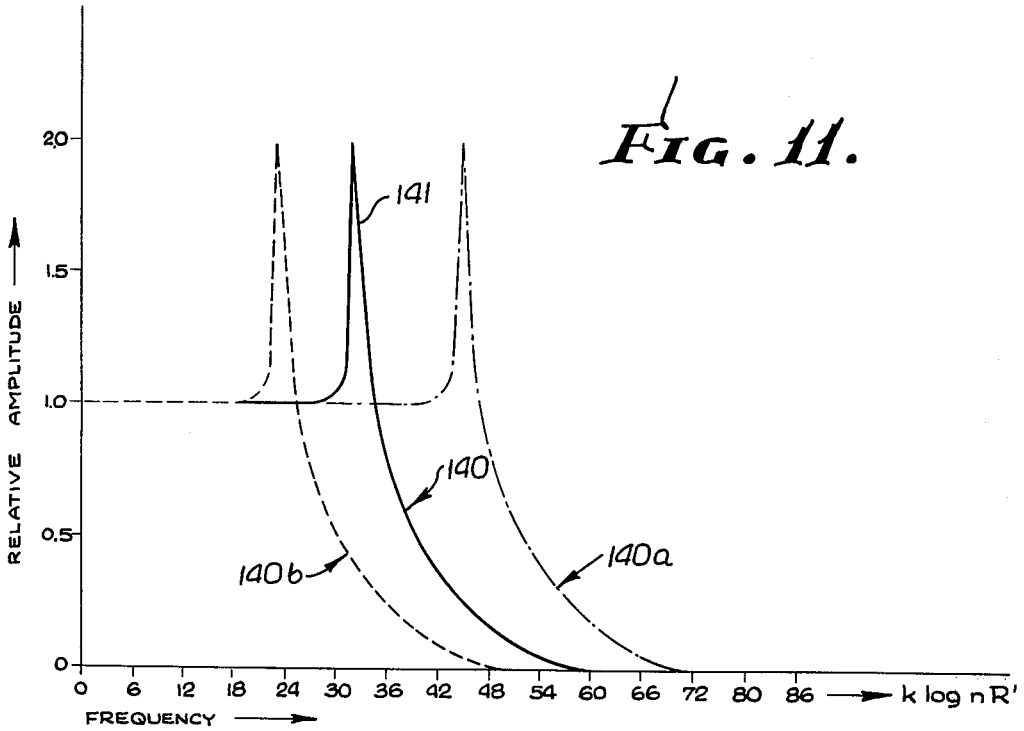
FIG. 11 is a graph illustrating the combined Q-resonance and low pass filter functions implemented by the circuitry of FIG. 10.

Harmonic accentuation of certain frequencies may be implemented with the circuitry 139 of FIG. 10 which provides the formant filter characteristics typified by the waveform 140 of FIG. 11. Here a low pass filter is combined with a "Q-resonance" peak 141, a frequency range in which the generated Fourier components are accentuated or increased in relative amplitude.

Formant filter factors defining the "Q-resonance" peak frequency and amount of amplitude accentuation are stored in a Q-resonance filter memory 142. The memory 142 is accessed by a control circuit 143 that is responsive to the value $k \log nR'$ present on the line 124. Advantageously, these filter factors are in a relatively narrow frequency range specified in terms of $k \log nR'$, as illustrated by the following Table V.

TABLE V

| k log nR' | Relative Amplitude | db Accentuation |
|---|---|---|
| | 1.00 | 0 |
| 27 | 1.00 | 0 |
| 28 | 1.03 | 0.26 |
| 29 | 1.10 | 0.83 |
| 30 | 1.90 | 5.58 |
| 31 | 1.50 | 3.52 |
| 32 | 1.00 | 0 |
| >= | 1.00 | 0 |

The memory 142 and the access control 143 are configured so that if the value $k \log nR'$ is less than 27 or greater than 32 (for the example of Table V), the formant filter value 1.00 is accessed from memory 142.

Each formant filter factor accessed from the memory 142 is supplied to a "Q-resonance" scaler 144. This circuit multiplies the product from the scaler 119 by the accessed accentuation factor from the memory 142. The new product is supplied via a line **49*a* to the attack/decay amplitude scaler 50. The values stored in the memories 107 and 142 may be appropriately selected together to produce a waveform such as that of FIG. 11,** and exemplified by the values of Tables IV and V.

Illustrative circuitry for achieving time variation of the formant filter passband also is illustrated in FIG. 10. Such time variation is achieved therein by storing a set of values M that modify the upper cut-off frequency $R_l$ in a memory 145. These different values of M are accessed by a control circuit 146 in response to timing circuitry 147. These circuits cooperate to provide on the line 123 values of M that vary in time in some predetermined manner. As described above in conjunction with FIGS. 6 and 7, these values M are added to the quantity $k \log nR'$ to cause a shift of the formant filter waveshape 140 either up or down in frequency, as indicated by the waveshapes 140*a* and 140*b* of FIG. 11.

The circuitry 147 (FIG. 10) includes a counter 148 that receives pulses from a clock 149 via a switch 150. From time to time, the contents of the counter 148 are provided via a line 148*a* to the memory access control 146. For example, a program control 151 may gate out the contents of the counter 148 each time a certain predetermined value is reached. This control circuit 151 may be preprogrammed appropriately so that different values M are accessed from the memory 145 either periodically, aperiodically, or in some other predetermined order. The counter 148 alternatively may be advanced upon generation of each full or fractional cycle of the note being produced. To this end, the switch 150 is set to the position in which the output from the note interval adder 36 (FIG. 3) is supplied via the switch 93 and a line 152 to the counter 148.

Figure 12:
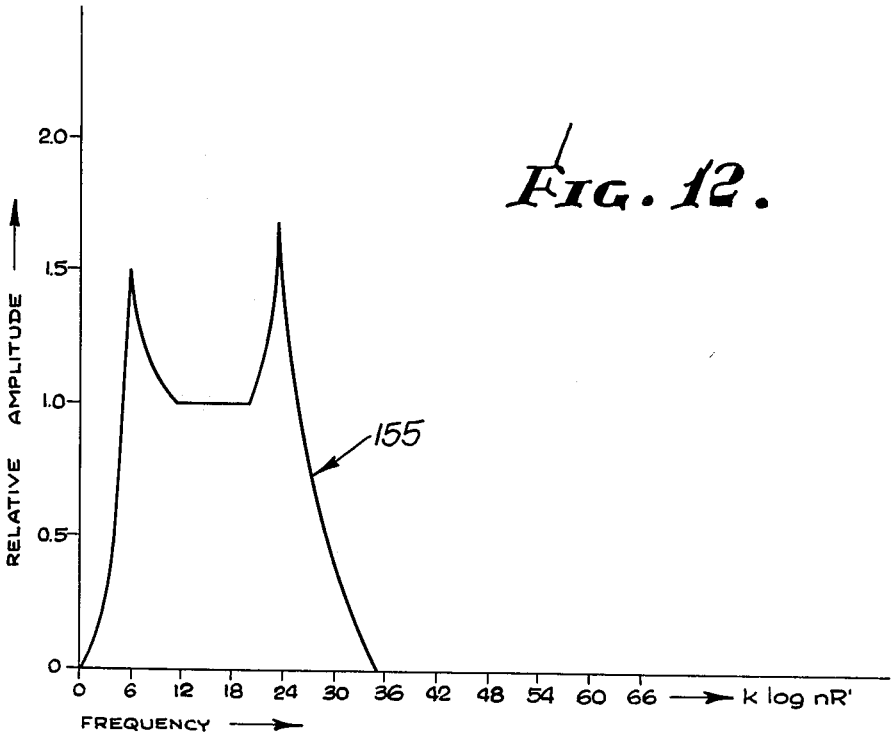
FIG. 12 is a graph showing a typical bandpass formant filter function including Q-resonance accentuation near both the high and low cutoff frequencies of the filter.

The circuitry of FIG. 10 adds a "Q-resonance" peak near the upper cut-off frequency of the formant filter passband. Similar circuitry may be used to insert such a "Q-resonance" peak near the lower cut-off frequency, resulting in an effective formant filter passband such as that illustrated by the waveform 155 of FIG. 12. The circuitry of FIG. 10 also is operative to shift simultaneously the upper cut-off frequency and the Q-resonance peak. However, it is readily apparent that the Q-resonance peak itself may be shifted in frequency independent of the upper cut-off frequency. For example, the Q-resonance peak could be shifted continuously through some relatively large frequency range while the upper and lower cut-off frequencies remained constant. Other variations may be employed.

In the formant filter embodiments described thus far, the passband has been defined in terms of frequency. The the extent to which a particular Fourier component will be attentuated or accentuated is determined by the frequency of that component and by the formant filter factor operative for that frequency. For example, the fundamental ($n$=1) Fourier component of the note $C_4$ lies within the passband of the formant filter function 121 of FIG. 6, whereas the fundamental of the note $C_7$ lies substantially outside this passband.

Figure 13:
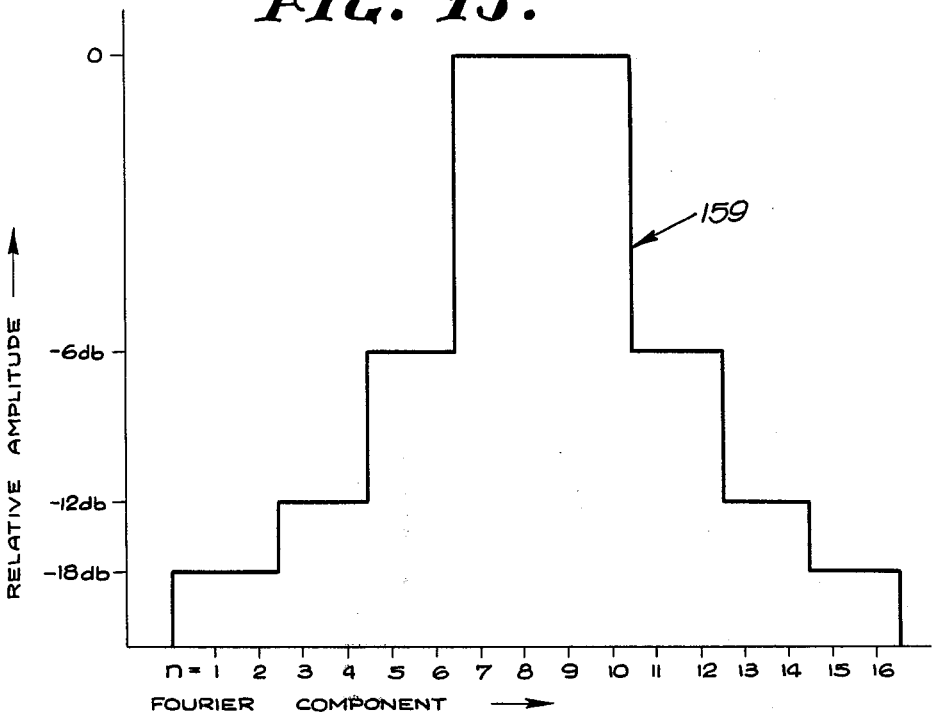
FIG. 13 is a graph showing the characteristics of a formant filter wherein the frequency is specified in terms of the harmonic component order.

By contrast, the formant filter passband may be defined in terms of the order $n$ of the Fourier component being generated. Such a function is illustrated by the waveshape 159 of FIG. 13, and is implemented by the circuitry 160 of FIG. 14. In this embodiment, the Fourier components of certain order are emphasized or attenuated regardless of the fundamental frequency of the note being generated. For the example of FIG. 13, the Fourier components of order $n$=7 through 10 are generated at full amplitude for each note. The Fourier components of order $n$=5,6,11 and 12 are attenuated by 6 db. In other words, the formant filter function 159 defines the attenuation for each individual component as a function of order $n$, but independent of the absolute frequency of that component.

To implement such a formant filter function, a set of 16 formant filter factors F ($n$) associated with the respective Fourier components of order $n$=1 through $n$=16 are contained in the corresponding positions 161-1 through 161-16 of a shift register 161. As each Fourier component is evaluated by the computor organ 20, the corresponding formant filter factor F($n$) is accessed from the shift register 161 and supplied via a line 162 to a scaler 163. This circuit multiplies the harmonic coefficient $C_n$ present on the line 47 by the supplied formant filter factor, and provides the product $C_nF(n)$ via a line 49*b* to the attack/decay amplitude scaler 50.

In a digital implementation wherein the harmonic coefficient $C_n$ specifies the relative amplitude of the $n^{th}$ Fourier component, the scaler 163 may comprise a shift register. A right shift of one binary position divides the value $C_n$ by two, and hence accomplishes an attenuation of 6 db. For such implementation, the formant filter factors F($n$) stored in the register 161 may simply define the number of positions by which the scaler 163 is to right shift the harmonic coefficient $C_n$. A shift of one position corresponds to an attenuation of 6 db, a shift of two positions accomplishes a 12 db attenuation, and so forth.

The factors F($n$) may be accessed from the register 161 under control of another shift register 164 that has corresponding storage locations 164-1 through 164-16. At the beginning of each waveshape amplitude computation interval $t_x$, a single binary 1 is entered into the first shift register position 164-1, and binary zeros are entered into all other positions of the register 164. At each Fourier component calculation interval $t_{cp}$ this single 1 is shifted to consecutive locations of the register 164. The formant filter factor F($n$) contained in the position of the register 161 corresponding to the location of the single 1 in the register 164 is supplied to the line 162. In this manner, for each order $n$ the corresponding factor F($n$) is supplied to the scaler 163.

Figure 15:
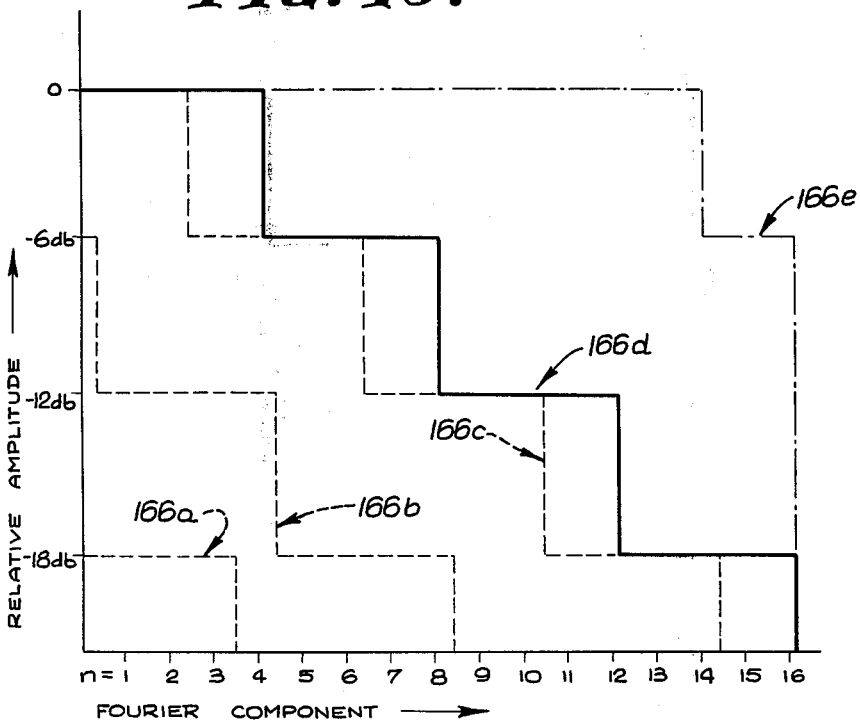
FIG. 15 is a graph showing an alternative formant filter function, also specified in terms of Fourier component order, and which is time variant.

Unusual effects, including "wah-wah" are achieved by sweeping the formant filter passband, so that Fourier components of different order are emphasized or attenuated as a function of time. This is illustrated in FIG. 15. At an early time, for example at the beginning of note production, the formant filter waveshape 166*a* is effective so that only the three lowest order ($n$=1,2,3) Fourier components are included in the generated musical waveshape. At a later time, the formant filter function 166*b* is operative so that the first four components ($n$=1 through 4) are included but attenuated by 12 db, the components of order $n$=5 through 8 are attenuated by 18 db, and no component of $n$=9 or greater is present. The waveforms 166*c*, 166*d* and 166*e* specify the Fourier components included in the waveshape amplitude computation at successive later times.

Figure 14:
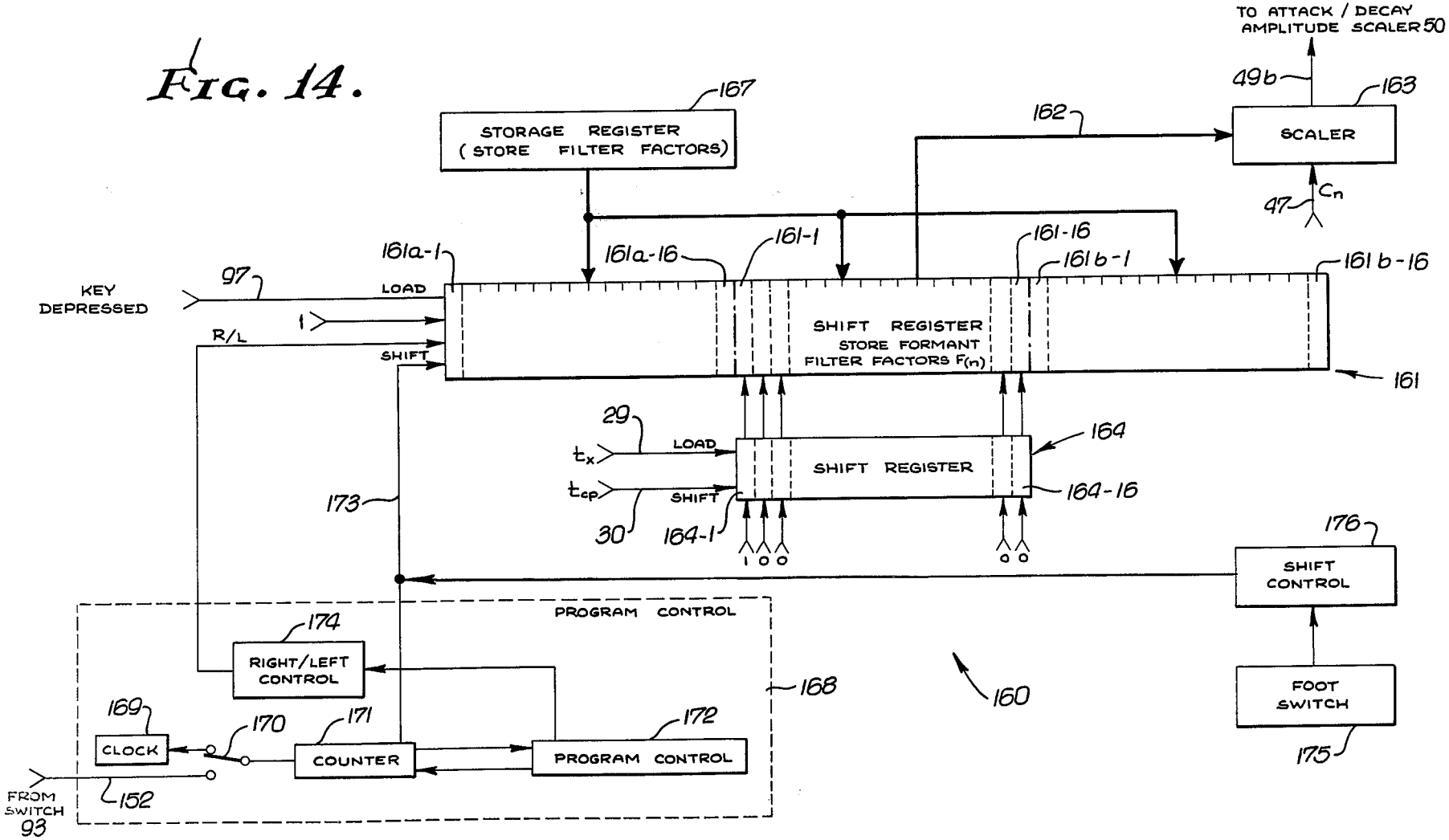
FIG. 14 is an electrical block diagram of circuitry for implementing a formant filter function of the type graphed in FIG. 13.

Such a time-variant or "sliding" formant filter function also may be implemented by the circuitry 160 of FIG. 14. To this end, the shift register 161 advantageously has a number of storage positions equal to three times the maximum number (W) of Fourier components that may be included in each waveshape amplitude computuation. Thus the illustrated register 161 includes the 16 storage positions 161-1 through 161-16 described above, together with another 16 storage locations **161*a*-1 through 161*a*-16 situated to the left of the position 161-1, and 16 positions 161*b*-1 through 161*b*-16 situated to the right of the position 161-16.**

A storage register 167 stores a set of factors F($n$) that defines the desired formant filter function at various times. For example, the register 167 may contain the factors listed in the following Table VI which would implement the function illustrated in FIG. 15.

TABLE VI

| Initial Entry Position Into Shift Register 161 | F(n) Relative Amplitude | F(n) No. of Places Right Shifted in Scaler 163 | db Attenuation |
|---|---|---|---|
| 161a-1 | 1.00 | 0 | 0 |
| 161a-2 | 1.00 | 0 | 0 |
| 161a-3 | 1.00 | 0 | 0 |
| 161a-4 | 1.00 | 0 | 0 |
| 161a-5 | 1.00 | 0 | 0 |
| 161a-6 | 1.00 | 0 | 0 |
| 161a-7 | 1.00 | 0 | 0 |
| 161a-8 | 0.50 | 1 | 6 |
| 161a-9 | 0.50 | 1 | 6 |
| 161a-10 | 0.50 | 1 | 6 |
| 161a-11 | 0.50 | 1 | 6 |
| 161a-12 | 0.25 | 2 | 12 |
| 161a-13 | 0.25 | 2 | 12 |
| 161a-14 | 0.25 | 2 | 12 |
| 161a-15 | 0.25 | 2 | 12 |
| 161a-16 | 0.125 | 3 | 18 |
| 161-1 | 0.125 | 3 | 18 |
| 161-2 | 0.125 | 3 | 18 |
| 161-3 | 0.125 | 3 | 18 |
| 161-4 | 0.00 | 8 | component excluded |
| 161-5 | 0.00 | 8 | component excluded |
| . | . | . | . . |
| . | . | . | . . |
| . | . | . | . . |
| 161-16 | 0.00 | 8 | component excluded |
| 161b-1 | 0.00 | 8 | component excluded |
| . | . | . | . . |
| . | . | . | . . |
| 161b-16 | 0.00 | 8 | component excluded |

Each time that a keyboard switch 21 is closed, the "key depressed" signal on the line 97 causes the entire set of filter factors stored in the register 167 to be loaded into the corresponding positions in the shift register 161. For the example of Table VI, the filter factors loaded into the positions 161-1 through 161-16 will produce the initial formant filter factor **166*a* of FIG. 15.**

A timing control circuit (FIG. 14) then controls the shifting of the entire set of formant filter factors contained in the register 161. To this end, a clock 169 provides pulses via a switch 170 to a counter 171. A program control circuit 172, responsive to the contents of the counter 171, gates a shift pulse via a line 173 to the shift register 161 each time that a certain preset count is reached in the counter 171. For example, such shift pulse may be provided each time say 25 timing pulses are received from the clock 169. The program control 172 also cooperates with a right-left control circuit 174 to establish whether the shift register 161 is to be right or left shifted. For the example of FIG. 15, only right shifting is employed. However, other programs may shift the set of formant filter factors in the register 161 both to the right and to the left in some programmed fashion as a function of time. By setting the switch 170 to its alternative position, the counter 171 may be advanced each cycle or fractional cycle of the note being generated. To this end, appropriate timing signals derived from the note interval adder 36 (FIG. 3) are supplied via the switch 93, the line 152 and the switch 170 to the counter 171.

Time variation of the formant filter function as illustrated by FIGS. 14 and 15 and by Table VI may be used to implement "wah-wah" and like sliding-formant effects. Use of the timing control circuit 168 results in automatic production of such time variant effects. Alternatively, the "sliding" of the formant filter may be controlled by the musician, for example by means of a foot switch 175 cooperating with a shift control 176. This control 176 provides to the line 173 appropriate shift control pulses as a function of motion of the foot switch 175. In other words, the set of formant filter factors contained in the register 161 is shifted to an extent controlled by the foot switch 175. In this manner, the formant filter function is made to vary under foot control.

Alternatively, the formant filter factors may be specified as a logarithmic function of Fourier component order. For example, such factors may be stored in a memory that is accessed in response only to a signal proportional to log $n$, such as that provided on the line 115 (FIG. 5).

The various components of the computer organ formant filtering system disclosed herein are conventional circuits well known in the digital computer art. As indicated by the following Table VII, many of these items are available commercially as integrated circuit components.

TABLE VII

| | Conventional Integrated Circuit* (or other ref.) | Remarks |
|---|---|---|
| Formant Filter Memory 76; and Memory Access Control 78; | (a)SIG 8223 field-programmable read only memory (ROM) [p. 37] (b)Ti SN5488A,SN7488A 256-bit ROM [p. 9-235] | The stored values of F(nR) are arbitrary, but are typified by FIG.4. |
| δR(t) Memory 82; Access Control 83 | Same as memory 76 and control 78 | The stored values of δ(R)t are arbitrary, but are typified by FIG. 4. |
| Formant Filter Memories 106 and 107; Access Controls 108 and 109 | Same as memory 76 and control 78 | The stored values of F(nR) are arbitrary, but are typified by FIGS 6 and 9. |
| Q-resonance Filter Memory 142 and Access Control 143 | Same as memory 76 and control 87 | The stored relative amplitude values are arbitrary, but are typified by Table V. |
| Cutoff Frequency | Same as memory 76 | The stored values |

TABLE VII-continued

| | Conventional Integrated Circuit* (or other ref.) | Remarks |
|---|---|---|
| Modification (M) Memory 145 and Access Control 146 | and control 87 | of M are arbitrary. |
| Scalers 119,144, 163 | (a)SIG 8243 scaler (b)May be implemented as shown in application sheet SIG catalog, p.28 using SIG 8202 buffer registers and 8260 arithmetic element | |
| Comparators 65, 66, 126, 134 | TI type SN54L85 or SN74L85 4-bit magnitude comparator | |
| Adder 81 | SIG. 8268 gated full adder | |
| Conversion Circuit 112 | Diode array | See Table II for input (corresponding to "Decimal") and output ("Binary") values. |
| Encoder 114 | Same as conversion circuit 112 | See Table III for input (n) and output ("Binary") values. |
| Shift Registers 161 and 164, Right/left Control 174 | TI type SN54L99 or SN74L99 4-bit right-shift/left-shift registers | |
| Storage Register 167 | TI type SN54L98 or SN74L98 4-bit data selectors/storage registers. | |
| Sinusoid table 42 and memory address decoder 41 | (a)TI TMS4405 sinusoid table and addressing circuitry (b)TI TMS4400 ROM containing 512 words of 8-bits [p.14-188] programmed to store sin values | Roundoff, if required, may be implemented per Ledley[2] section 4-6. |
| Harmonic coefficient memory 45 and memory address control 46 | (a)SIG 8277 sixteen-bit shift register [p.121] (b)TI SN54166 series shift registers [p.9-134] (c)Also can be implemented using a read only memory such as SIG 8223 which includes address control circuitry | |
| Harmonic Amplitude Multiplier 56 | (a)May be implemented as shown in application sheet SIG catalog, p.28 using SIG 8202 buffer registers and 8260 arithmetic element (b)Also can be implemented using SIG 8243 scaler [p.65] | |
| Frequency number memory 26 | (a)SIG 8223 field-programmable read only memory (ROM) [p.37] (b)TI SN5488A, SN7488A 256-bit ROM [p.9-235] | The stored values of R are listed in TABLE I. |
| Note interval adder 36 | (a)SIG 8260 arithmetic logic element [p.37] (b)SIG 8268 gated full adder [p.97] (c)TI SN5483, SN7483 4-bit binary full adders [p.9-271] as shown in Flores[1] Section 11.1 to accumulate sum | |
| Harmonic interval adder 39 | Same as note interval adder 36 | |
| Accumulator 58 | (a)SIG 8268 or TI SN5483, SN7483 full adders connected as shown in Flores[1], section 11.1 "Accumulators." | |
| Attack/decay scale factor memory 52 | SIG 8223 field-programmable read only memory [p.37] | |
| Coefficient | SIG 8243 scaler [p.65] | |

TABLE VII-continued

| | Conventional Integrated Circuit* (or other ref.) | Remarks |
|---|---|---|
| scaler 50 | | |

*TI = Texas Instrument Co.
[Page references are to the TI "Integrated Circuits Catalog for Design Engineers," First Edition, January 1972]
SIG — Signetics, Sunnyvale, California
[Page references are to the SIG "Digital 8000 Series TTL/MSI" catalog, copyright 1971]
[2]Ledley, Robert, "Digital Computer and Control Engineering" McGraw-Hill, 1960.
[1]Flores, Ivan, "Computer Logic," Prentice-Hall, 1960

Intending to claim all novel, useful and unobvious features, shown or described, the applicant claims:

1. In an electronic musical instrument of the type wherein musical tones are synthesized in real time, said instrument having generation means for individually evaluating the constituent Fourier components of a musical waveshape, the relative amplitudes of said Fourier components with respect to each other being established by a set of harmonic coefficients stored in said generation means, an accumulator for accumulating these components to obtain the successive sample point amplitudes of said waveshape, and a converter connected to said accumulator for converting said amplitudes to musical tones, the improvement wherein the Fourier components of certain order are selectively modified in amplitude, comprising, scaler means, connected to said generation means, for scaling the amplitude of each constituent Fourier component as it is evaluated, the amount to which each component is scaled being established by a scaling factor $F(n)$ supplied to said scaling means, and scaling factor supply means for supplying to said scaler means that scaling factor associated with the order n of the constituent Fourier component currently being evaluated by said generation means.

2. An electronic musical instrument according to claim 1 wherein said scaling factor supply means comprises;

storage means storing a set of said scaling factors $F(n)$, and access means for accessing from said storage means and supplying to said scaler means the scaling factor $F(n)$ corresponding to the order n of the Fourier component currently being evaluated.

3. An electronic musical instrument according to claim 1 further comprising;

means for modifying the values of the scale factors supplied by said supply means as a function of time.

4. In an electronic musical instrument of the type wherein musical tones are synthesized in real time, said instrument having generation means for individually evaluating the constituent Fourier components by a musical waveshape, an accumulator for accumulating these components to obtain the successive sample point amplitudes of said waveshape, and a converter connected to said accumulator to convert said amplitudes to musical tones, the improvement for providing accentuation of Fourier components lying within a certain narrow frequency range, comprising;

storage means providing a set of amplitude scaling factors specified in terms of frequency for said narrow frequency range, each scaling factor having a value that effectively increases the amplitude of a constituent Fourier component above its unaccentuated value, component frequency determination means, connected to said generation means and to said storage means, for determining the frequency of each currently evaluated Fourier component and for obtaining from said storage means the corresponding amplitude scaling factor, and accentuation means for scaling the currently evaluated Fourier component by said accessed scaling factor, said scaled components being provided to said accumulator, so that the synthesized musical waveshape includes components of accentuated amplitude within said narrow frequency range.

5. In a musical instrument of the type including generation means wherein a musical waveshape is synthesized by computing in real time the amplitudes at successive sample points of that waveshape, said waveshape amplitudes being converted to musical signals as the computations are carried out, said generation means including calculation circuitry for individually calculating the constituent Fourier components of that musical waveshape, and an accumulator for summing these Fourier components to obtain each waveshape amplitude, the relative amplitudes of said Fourier components with respect to each other being established by a set of harmonic coefficients, the improvement comprising:

first means for providing a set of formant filter factors that specify attenuation as a function of frequency, said set thereby defining a "formant filter" function having a passband, said first means being connected to said calculation circuitry to receive therefrom a signal indicative of the frequency of each individual Fourier component being calculated thereby, and scaler means connected to said first means to receive therefrom the formant filter factor which specifies the attenuation at the frequency of that Fourier component currently being calculated by said calculation circuitry, said scaler means being connected to said calculation circuitry individually to scale that currently calculated Fourier component by said received formant filter factor, the scaled component then being supplied to said accumulator for summation therein, so that the resultant musical waveshape is synthesized only from scaled Fourier components within the passband defined by said formant filter function.

6. A musical instrument according to claim 5 wherein said formant filter factors are unity within said passband and zero outside of said passband, said first means comprising;

a comparator for comparing the frequency of the Fourier component currently being calculated with a cutoff frequency of said passband, and wherein said scaler means comprises, a gate enabled by said comparator for gating each harmonic coefficient to said calculation circuitry only if the currently evaluated Fourier component has a frequency within said passband.

7. A musical instrument according to claim 5 wherein said first means comprises;

a memory storing said set of formant filter factors, and an access control circuit for accessing from said memory the formant filter factor that specifies the filter function at the frequency of the Fourier component currently being calculated and wherein said scaler means comprises, a multiplier for multiplying each harmonic coefficient by the formant filter factor accessed from said memory, the product being provided to said calculation circuitry.

8. A musical instrument accordiing to claim 7 further comprising;

time variation circuitry for modifying as a function of time which stored formant filter factor is accessed from said memory for a certain Fourier component frequency.

9. A musical instrument according to claim 7 wherein said formant filter factors are specified as a logarithmic function of frequency, and further comprising;

conversion circuitry for providing a signal representative of a logarithmic function of the frequency of the Fourier component currently being evaluated, said access control circuit being responsive to said provided signal.

10. A musical instrument according to claim 7 including;

separate memories respectively storing the formant filter factors specifying the high pass and low pass characteristics of said formant filter function, and access modification circuitry for separately modifying which stored formant filter factor is accessed from said memories for a certain Fourier component frequency, thereby facilitating separate control of the upper and lower cutoff frequencies of said formant filter passband.

11. A musical instrument according to claim 7 further comprising;

a second memory storing a set of factors specifying the accentuation as a function of frequency for Fourier components in a certain frequency range within the formant filter passband, an access control unit for accesssing from said second memory the applicable accentuation factor during calculation of a Fourier component having a frequency within said certain range, and a second scaler for multiplying the product from said multiplier by the accessed accentuation factor, the resultant product being provided to said calculation circuitry.

12. A musical instrument according to claim 7 wherein said formant filter function specifies attenuation as a function of the order of said Fourier components, said access control circuit accessing from said memory the formant filter factor corresponding to the order of the Fourier component currently being calculated.

13. A musical instrument according to claim 12 wherein said memory comprises;

a shift register having separate storage positions each containing a formant filter factor that specifies attenuation for a certain Fourier component order, said access control circuit accessing formant filter factors sequentially from certain of said storage positions, together with, program control means for causing said shift register to shift the contents thereof as a function of time so that different subsets of filter factors will be contained in said certain storage positions, whereby time variation of said formant filter function is accomplished.

14. Apparatus for implementing formant filtering in an electronic musical instrument of the type wherein musical tones are synthesized in real time, said instrument having;

first means for computing at regular time intervals $t_x$ the amplitudes $X_o(qR)$ of a waveshape, where $q$ is an integer incremented each time interval $t_x$, in accordance with the relationship $$X_o(qR) = \sum_{N=1}^{W} S(t)FC_n \sin \frac{\pi}{W} nqR$$

wherein $n$=1,2,3, . . . W designates the order of the Fourier components which can be included in each waveshape amplitude computation, where $C_n$ is a coefficient establishing the relative amplitude of the corresponding $n^{th}$ component relative to the other components, wherein R is a frequency number proportional to the fundamental frequency of a selected note, wherein $S(t)$ is a time dependent scale factor establishing the amplitude envelope characteristics of each tone during attack, sustain and decay, and wherein F is one of a set of formant filter factors specifying attenuation as a function of frequency, thereby defining a formant filter passband, said first means providing a signal designating the order n of the Fourier component currently being evaluated, and second means responsive to said first means for providing musical tones from said obtained amplitudes, said musical tones containing only Fourier components within said passband, said apparatus for implementing formant filtering comprising;

harmonic coefficient supply circuitry, connected to said first means to received said order-designating signal, for supplying to a scaler means the coefficient $C_n$ in correspondence with the order $n$ of the Fourier component currently being evaluated, formant filter supply circuitry for supplying to said scaler means the factor F applicable to said currently evaluated Fourier component, and scaler means, connected to said first means, for multiplying each coefficient $C_n$ supplied from said coefficient supply circuitry by the corresponding factor F supplied from said formant filter supply circuitry, and for providing the product $FC_n$ to said first means for utilization thereby.

15. Apparatus according to claim 14 wherein said formant filter factors are unity within said passband and zero outside of said passband, the lower and upper cutoff frequencies $R_L$ and $R_U$ of said passband being specified in terms of frequency number, the value $n$R designating the frequency of each Fourier component, said formant filter supply circuitry comprising;

comparator means for comparing the frequency $n$R of the currently evaluated Fourier component with the cutoff frequencies of said passband, and for providing a gate enabling signal if the frequency $n$R is within said passband, and wherein said scaler means comprises, gating circuitry for providing the supplied coefficient $C_n$ to said first means only upon occurrence of said gate enabling signal from said comparator means.

16. Apparatus according to claim 14 wherein said formant filter supply circuitry comprises;

a memory storing said set of formant filter factors, said factors being specified in terms of frequency number, and memory access control receiving the value $n$R designating the frequency of the Fourier component currently being evaluated, said control accessing from said memory the formant filter factor having a specifying frequency number that corresponds to the received value $n$R, said accessed factor being supplied to said scaler means.

17. Apparatus according to claim 16 wherein said electronic musical instrument includes keyboard selection switches and a frequency number memory that provides to said first means the selected frequency number R corresponding to the fundamental frequency of the tone selected by said keyboard switches, said formant filter supply circuitry also including a circuit that receives from said frequency number memory said selected frequency number R and which evaluates said value $n$R, where $n$ is the order of the currently evaluated Fourier component.

18. Apparatus according to claim 16 further comprising an adder for adding to said received value $n$R an amount $\delta$R, said memory access control accessing from said memory the factor associated with the sum ($n$R+$\delta$R), thereby effectively shifting in frequency said formant filter passband.

19. Apparatus according to claim 18 further comprising time modification circuitry for varying the amount $\delta$R in time, so that the formant filter passband likewise will change with time.

20. Apparatus according to claim 16 wherein said formant filter factors are specified as a logarithmic function of frequency number, and wherein said formant filter supply circuitry further comprises;

a conversion circuit for providing a signal indicative of a value logarithmically related to the frequency number of the selected note, an encoder providing a signal lograrithmically related to the order $n$ of the Fourier component currently being evaluated, and an adder for summing said logarithmically related signals, said memory access control receiving the sum obtained by said added and accessing from said memory the formant filter factor corresponding to the received logarithmic sum.

21. Apparatus according to claim 20 wherein said logarithmic function of frequency number is $k \log jR$ wherein $j$ and $k$ are constants selected so that for the lowest note of said instrument, $k \log jR = 0$ and for the highest note of said instrument, $k \log jR = p$ where $p$ equals the number of notes that can be selected.

22. Apparatus according to claim 21 wherein there are separate memories respectively storing the formant filter factors defining the high pass and low pass characteristics of said formant filter passband, and further comprising means for separatly adding a constant to the value ($k \log jR$) supplied to the respective memories so as to modify independently the effective lower and upper cutoff frequencies of said passband.

23. Apparatus according to claim 16 wherein said memory also stores formant filter factors for accentuating Fourier components within a certain frequency range.

24. Apparatus according to claim 16 further comprising;

a second memory means for providing accentuation formant filter factors specifying the accentuation for each Fourier component in a certain frequency range, and a second scaler receiving the provided accentuation formant filter factor, said second scaler and said scaler means together supplying to said first means the product of $FC_n$ times the provided accentuation formant filter factor.

25. Apparatus according to claim 14 wherein said formant filter factors are specified in terms of the Fourier component order $n$, and wherein said formant filter supply circuitry comprises;

a memory storing a set of formant filter factors F($n$) each associated with a respective value $n$, and access circuitry for accessing from said memory and supplying to said scaler means the factor F($n$) corresponding to the order $n$ of the Fourier component currently being evaluated.

26. Apparatus according to claim 25 further comprising;

time modification circuitry for changing the values F($n$) in said memory progressively with time.

27. Apparatus according to claim 25 wherein said time modification circuitry comprises;

means for sequentially shifting a certain set of values F($n$) through successive storage positions of said memory, thereby implementing a "sliding" formant filter function.

28. Apparatus for implementing formant filtering in an electronic musical instrument of the type wherein musical tones are synthesized in real time, said apparatus comprising;

first means for computing at regular time intervals $t_x$ the amplitudes $X_o(qR)$ of a waveshape, where $q$ is an integer incremented each time interval $t_x$, in accordance with the relationship $$X_o(qR) = \sum_{n=1}^{W} F(nR)C_n \sin \frac{\pi}{W} nqR$$

wherein $n$=1,2,3 . . . W designates the order of the Fourier components which can be included in each waveshape amplitude computation, wherein $C_n$ is a coefficient establishing the amplitude of the corresponding $n^{th}$ component relative to the other components, each coefficient $C_n$ being supplied in unison with evaluation of the corresponding $n^{th}$ Fourier component, wherein R is a frequency number proportional to the fundamental frequency of a selected note, and wherein F($n$R) is one of a set formant filter factors specifying attenuation as a function of frequency, said set thereby defining a formant filter passband, and second means responsive to said first means for providing musical tones from said obtained amplitudes, said musical tones containing only Fourier components within said passband, a memory storing a set of formant filter factors F($n$R) specified as a logarithmic function of the frequency number ($n$R) designating the frequency of the $n^{th}$ Fourier component, logarithmic value means for providing a signal representing a value logarithmically related to the frequency number ($n$R) of the Fourier component currently being evaluated, an access control for accessing from said memory means the factor F($n$R) associated with the logarithmically related value represented by said signal from said logarithmic value means, and a scaler for scaling the coefficient $C_n$ for the currently evaluated Fourier component by the factor F($n$R) accessed from said memory, so that the synthesized tone contains only constituent Fourier components within said passband and having scaled amplitudes established by said set of formant filter factors.

29. Apparatus according to claim 28 wherein said electronic musical instrument has a set of note selection keyboard switches, each switch being designated by a respective, consecutive integer S having a value 0 through $s$ where $s$ designates the total number of such switches, said logarithmic value means being responsive to note selection by one of said switches and providing a signal of the value $k \log jR$ wherein $k$ and $j$ are constants selected so that $k \log jR = S$ for each note selected on said keyboard switches.

* * * * *